US010641146B2

(12) United States Patent
Inoshita et al.

(10) Patent No.: US 10,641,146 B2
(45) Date of Patent: May 5, 2020

(54) EXHAUST PURIFICATION SYSTEM OF INTERNAL COMBUSTION ENGINE

(71) Applicant: TOYOTA JIDOSHA KABUSHIKI KAISHA, Toyota-shi, Aichi-ken (JP)

(72) Inventors: Kenji Inoshita, Okazaki (JP); Shogo Tanaka, Toki (JP); Norihisa Nakagawa, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 32 days.

(21) Appl. No.: 16/160,242

(22) Filed: Oct. 15, 2018

(65) Prior Publication Data

US 2019/0120107 A1 Apr. 25, 2019

(30) Foreign Application Priority Data

Oct. 19, 2017 (JP) ..... 2017-202958

(51) Int. Cl.

| | |
|---|---|
| ***F01N 3/00*** | (2006.01) |
| ***F01N 3/20*** | (2006.01) |
| ***F02M 26/00*** | (2016.01) |
| ***F01N 9/00*** | (2006.01) |
| ***F01N 11/00*** | (2006.01) |

(52) U.S. Cl.

CPC ..... *F01N 3/20* (2013.01); *F01N 9/00* (2013.01); *F01N 11/007* (2013.01); *F02M 26/00* (2016.02); *F01N 2550/05* (2013.01); *F01N 2560/025* (2013.01); *F01N 2560/14* (2013.01); *F01N 2900/0601* (2013.01); *F01N 2900/1402* (2013.01); *F02M 2026/009* (2016.02)

(58) Field of Classification Search

CPC . F02M 26/00; F01N 11/07; F01N 9/00; F01N 3/20

USPC ..... 60/276

See application file for complete search history.

(56) References Cited

U.S. PATENT DOCUMENTS

| | | | | |
|---|---|---|---|---|
| 6,357,224 | B1 * | 3/2002 | Kawamoto | F01N 3/0842 60/277 |
| 9,624,811 | B2 * | 4/2017 | Okazaki | F02D 41/0295 |
| 2003/0017603 | A1 * | 1/2003 | Uchida | B01D 53/9495 436/37 |

(Continued)

FOREIGN PATENT DOCUMENTS

JP 2015-071963 4/2015

*Primary Examiner* — Jason D Shanske

(74) *Attorney, Agent, or Firm* — Finnegan, Henderson, Farabow, Garrett & Dunner, LLP

(57) ABSTRACT

An exhaust purification system comprises a catalyst 20, an upstream side air-fuel ratio sensor 40, a downstream side air-fuel ratio sensor 41, and an air-fuel ratio control device. The air-fuel ratio control device alternately switches a target air-fuel ratio between a rich set air-fuel ratio and a lean set air-fuel ratio, calculates an oxygen storage amount and an oxygen discharge amount, updates a learning value, and corrects an air-fuel ratio-related parameter based on the learning value. The air-fuel ratio control device changes a condition for switching the target air-fuel, stores the learning value at the time when the operating state of the internal combustion engine changes from the first state to the second state as a first state value, and updates the learning value to the first state value when the operating state of the internal combustion engine returns from the second state to the first state.

13 Claims, 12 Drawing Sheets

(56) References Cited

U.S. PATENT DOCUMENTS

| | | | | |
|---|---|---|---|---|
| 2008/0147297 | A1* | 6/2008 | Nakagawa | F02D 41/1441 701/103 |
| 2010/0146936 | A1* | 6/2010 | Sawada | F01N 11/00 60/277 |
| 2012/0023913 | A1* | 2/2012 | Yoshioka | F01N 11/002 60/285 |
| 2015/0322878 | A1* | 11/2015 | Okazaki | F02D 41/0295 60/285 |
| 2016/0245145 | A1 | 8/2016 | Okazaki et al. | |
| 2017/0058749 | A1* | 3/2017 | Miyamoto | F01N 11/007 |
| 2017/0096926 | A1* | 4/2017 | Morihiro | F01N 9/007 |

* cited by examiner

EXHAUST PURIFICATION SYSTEM OF INTERNAL COMBUSTION ENGINE

FIELD

The present invention relates to an exhaust purification system of an internal combustion engine.

BACKGROUND

It has been known in the past to arrange a catalyst able to store oxygen in an exhaust passage of an internal combustion engine and remove unburned gas (HC, CO, etc.) and $NO_X$ in the exhaust gas at the catalyst. The higher the oxygen storage ability of the catalyst, the greater the amount of oxygen which can be stored in the catalyst and the better the exhaust purification performance of the catalyst.

To maintain the oxygen storage ability of the catalyst, the oxygen storage amount of the catalyst preferably is made to fluctuate so that the oxygen storage amount of the catalyst is not maintained constant. In the internal combustion engine described in PTL 1, to make the oxygen storage amount of the catalyst fluctuate, the target air-fuel ratio of the exhaust gas flowing into the catalyst is alternately switched between a lean air-fuel ratio leaner than a stoichiometric air-fuel ratio and a rich air-fuel ratio richer than the stoichiometric air-fuel ratio. Specifically, when the air-fuel ratio detected by the downstream side air-fuel ratio sensor becomes a rich judged air-fuel ratio richer than the stoichiometric air-fuel ratio or becomes less, the target air-fuel ratio is switched from the rich air-fuel ratio to the lean air-fuel ratio, while when the estimated value of the amount of oxygen stored at the catalyst becomes a switching reference value or more while the target air-fuel ratio is maintained at the lean air-fuel ratio, the target air-fuel ratio is switched from the lean air-fuel ratio to the rich air-fuel ratio.

Further, if such control is performed, an air-fuel ratio-related parameter is corrected by learning control so as to keep the exhaust emission from deteriorating due to deviation of the output value of the upstream side air-fuel ratio sensor. Specifically, the oxygen storage value, which is the estimated value of the amount of oxygen stored at the catalyst while the target air-fuel ratio is maintained at the lean air-fuel ratio, and the oxygen discharge amount, which is the estimated value of the amount of oxygen discharged from the catalyst while the target air-fuel ratio is maintained at the rich air-fuel ratio, are calculated, the learning value is updated based on a difference between the oxygen storage amount and the oxygen discharge amount, and the air-fuel ratio-related parameter is corrected based on the learning value so that the difference between the oxygen storage amount and the oxygen discharge amount becomes smaller.

CITATION LIST

Patent Literature

PTL 1: Japanese Patent Publication No. 2015-071963A

SUMMARY

Technical Problem

In this regard, even if the target air-fuel ratio is set, the state of the exhaust gas flowing into the catalyst fluctuates in accordance with the operating state of the internal combustion engine. For this reason, to keep the exhaust emission from deteriorating while maintaining the oxygen storage ability of the catalyst, sometimes it is preferable to change the condition for switching the target air-fuel ratio (rich judged air-fuel ratio and switching reference value in PTL 1) in accordance with the operating state of the internal combustion engine.

For example, if the rich degree of the rich judged air-fuel ratio is made larger, the timing for switching the target air-fuel ratio from the rich air-fuel ratio to the lean air-fuel ratio becomes delayed. As a result, the time period during which the target air-fuel ratio is maintained at the rich air-fuel ratio becomes longer and the oxygen discharge amount becomes greater. On the other hand, if the switching reference value is made larger, the timing for switching the target air-fuel ratio from the lean air-fuel ratio to the rich air-fuel ratio becomes delayed. As a result, the time period during which the target air-fuel ratio is maintained at the lean air-fuel ratio becomes longer and the oxygen storage amount becomes greater.

Therefore, if the condition for switching the target air-fuel ratio changes, even if the output of the upstream side air-fuel ratio sensor is normal, sometimes the learning value calculated from the oxygen storage amount and the oxygen discharge amount will change. As a result, the suitable learning value will fluctuate in accordance with the operating state of the internal combustion engine. For this reason, if the learning value is maintained when the operating state of the internal combustion engine changes, the air-fuel ratio of the exhaust gas flowing into the catalyst becomes a value not suitable to the changed operating state and the exhaust emission is liable to deteriorate.

Therefore, in consideration of the above problem, the object of the present invention is to keep the exhaust emission from deteriorating when changing the condition for switching the target air-fuel ratio of the exhaust gas flowing into the catalyst in accordance with the operating state of the internal combustion engine.

Solution to Problem

The summary of the present disclosure is as follows.

(1) An exhaust purification system of an internal combustion engine comprising: a catalyst arranged in an exhaust passage and able to store oxygen; an upstream side air-fuel ratio sensor arranged at an upstream side of the catalyst in a direction of flow of exhaust and detecting an air-fuel ratio of inflowing exhaust gas flowing into the catalyst; a downstream side air-fuel ratio sensor arranged at a downstream side of the catalyst in the direction of flow of exhaust and detecting an air-fuel ratio of outflowing exhaust gas flowing out from the catalyst; and an air-fuel ratio control device configured to control an air-fuel ratio of the inflowing exhaust gas, wherein the air-fuel ratio control device is configured to alternately switch a target air-fuel ratio of the inflowing exhaust gas between a rich set air-fuel ratio richer than a stoichiometric air-fuel ratio and a lean set air-fuel ratio leaner than a stoichiometric air-fuel ratio, calculate an oxygen storage amount which is an estimated value of an amount of oxygen stored at the catalyst while the target air-fuel ratio is maintained at the lean set air-fuel ratio, and an oxygen discharge amount which is an estimated value of an amount of oxygen discharged from the catalyst while the target air-fuel ratio is maintained at the rich set air-fuel ratio, based on an air-fuel ratio detected by the upstream side air-fuel ratio sensor, update a learning value based on a difference of the oxygen storage amount and the oxygen discharge amount, and correct an air-fuel ratio-related parameter based on the learning value so that the difference of the oxygen storage amount and the oxygen discharge amount becomes smaller, and an operating state of the internal combustion engine changes between a first state and a second state, and the air-fuel ratio control device is configured to change a condition for switching the target air-fuel ratio between the first state and the second state, store the learning value at the time when the operating state of the internal combustion engine changes from the first state to the second state as a first state value, and update the learning value to the first state value when the operating state of the internal combustion engine returns from the second state to the first state.

(2) The exhaust purification system of an internal combustion engine described in above (1), wherein the air-fuel ratio control device is configured to store the learning value at the time when the operating state of the internal combustion engine changes from the second state to the first state as a second state value, and update the learning value to the second state value when the operating state of the internal combustion engine returns from the first state to the second state.

(3) The exhaust purification system of an internal combustion engine described in above (1) or (2), wherein the air-fuel ratio control device is configured to switch the target air-fuel ratio from the rich set air-fuel ratio to the lean set air-fuel ratio when the air-fuel ratio detected by the downstream side air-fuel ratio sensor reaches a rich judged air-fuel ratio, and switch the target air-fuel ratio from the lean set air-fuel ratio to the rich set air-fuel ratio when the air-fuel ratio detected by the downstream side air-fuel ratio sensor reaches a lean judged air-fuel ratio, the rich judged air-fuel ratio being an air-fuel ratio richer than a stoichiometric air-fuel ratio and leaner than the rich set air-fuel ratio, and the lean judged air-fuel ratio being an air-fuel ratio leaner than a stoichiometric air-fuel ratio and richer than the lean set air-fuel ratio, and the air-fuel ratio control device is configured to change a value of at least one of the rich judged air-fuel ratio and the lean judged air-fuel ratio between the first state and the second state.

(4) The exhaust purification system of an internal combustion engine described in above (3), wherein if the oxygen storage amount reaches a threshold value before the air-fuel ratio detected by the downstream side air-fuel ratio sensor reaches the lean judged air-fuel ratio, the air-fuel ratio control device is configured to switch the target air-fuel ratio from the lean set air-fuel ratio to the rich set air-fuel ratio when the oxygen storage amount reaches the threshold value, and the air-fuel ratio control device is configured to update the threshold value based on the oxygen storage amount and the oxygen discharge amount, store the threshold value at the time when the operating state of the internal combustion engine changes from the first state to the second state as a first state threshold value, and update the threshold value to the first state threshold value when the operating state of the internal combustion engine returns from the second state to the first state.

(5) The exhaust purification system of an internal combustion engine described in above (4), wherein the air-fuel ratio control device is configured to store the threshold value at the time when the operating state of the internal combustion engine changes from the second state to the first state as a second state threshold value, and update the threshold value to the second state threshold value when the operating state of the internal combustion engine returns from the first state to the second state.

(6) The exhaust purification system of an internal combustion engine described in above (1) or (2), wherein the air-fuel ratio control device is configured to switch the target air-fuel ratio from the rich set air-fuel ratio to the lean set air-fuel ratio when the air-fuel ratio detected by the downstream side air-fuel ratio sensor reaches a rich judged air-fuel ratio and switch the target air-fuel ratio from the lean set air-fuel ratio to the rich set air-fuel ratio when the oxygen storage amount reaches a switched storage amount smaller than a maximum oxygen storage amount, the rich judged air-fuel ratio being an air-fuel ratio richer than a stoichiometric air-fuel ratio and leaner than the rich set air-fuel ratio, and the air-fuel ratio control device is configured to change a value of at least one of the rich judged air-fuel ratio and the switched storage amount between the first state and the second state.

(7) The exhaust purification system of an internal combustion engine described in any one of above (1) to (6), wherein the air-fuel ratio control device is configured to change a value of at least one of the rich set air-fuel ratio and the lean set air-fuel ratio between the first state and the second state.

(8) The exhaust purification system of an internal combustion engine described in any one of above (1) to (7), wherein the first state is a nonsteady state, and the second state is a steady state.

(9) The exhaust purification system of an internal combustion engine described in any one of above (1) to (7), wherein the first state is a steady state, and the second state is a nonsteady state.

(10) The exhaust purification system of an internal combustion engine described in any one of above (1) to (7), wherein an EGR passage for making a part of the exhaust gas flowing through the exhaust passage recirculate as EGR gas to an intake passage is provided at the internal combustion engine, and the first state is a low EGR state where an EGR gas flow rate is less than a first predetermined value and the second state is a high EGR state where the EGR gas flow rate is the first predetermined value or more, or the first state is a low EGR state where the EGR rate is less than a second predetermined value and the second state is a high EGR state where the EGR rate is the second predetermined value or more.

(11) The exhaust purification system of an internal combustion engine described in any one of above (1) to (7), wherein an EGR passage for making a part of the exhaust gas flowing through the exhaust passage recirculate as EGR gas to an intake passage is provided at the internal combustion engine, and the first state is a high EGR state where an EGR gas flow rate is a first predetermined value or more and the second state is a low EGR state where the EGR gas flow rate is less than the first predetermined value, or the first state is a high EGR state where the EGR rate is a second predetermined value or more and the second state is a low EGR state where the EGR rate is less than the second predetermined value.

(12) The exhaust purification system of an internal combustion engine described in any one of above (1) to (7), wherein the first state is a high load state where an engine load is a predetermined value or more, and the second state is a low load state where the engine load is less than the predetermined value.

(13) The exhaust purification system of an internal combustion engine described in any one of above (1) to (7), wherein the first state is a low load state where an engine load is less than a predetermined value, and the second state is a high load state where the engine load is the predetermined value or more.

Advantageous Effects of Invention

According to the present invention, it is possible to keep the exhaust emission from deteriorating when changing the condition for switching the target air-fuel ratio of the exhaust gas flowing into the catalyst in accordance with the operating state of the internal combustion engine.

DESCRIPTION OF EMBODIMENTS

Figure 1:
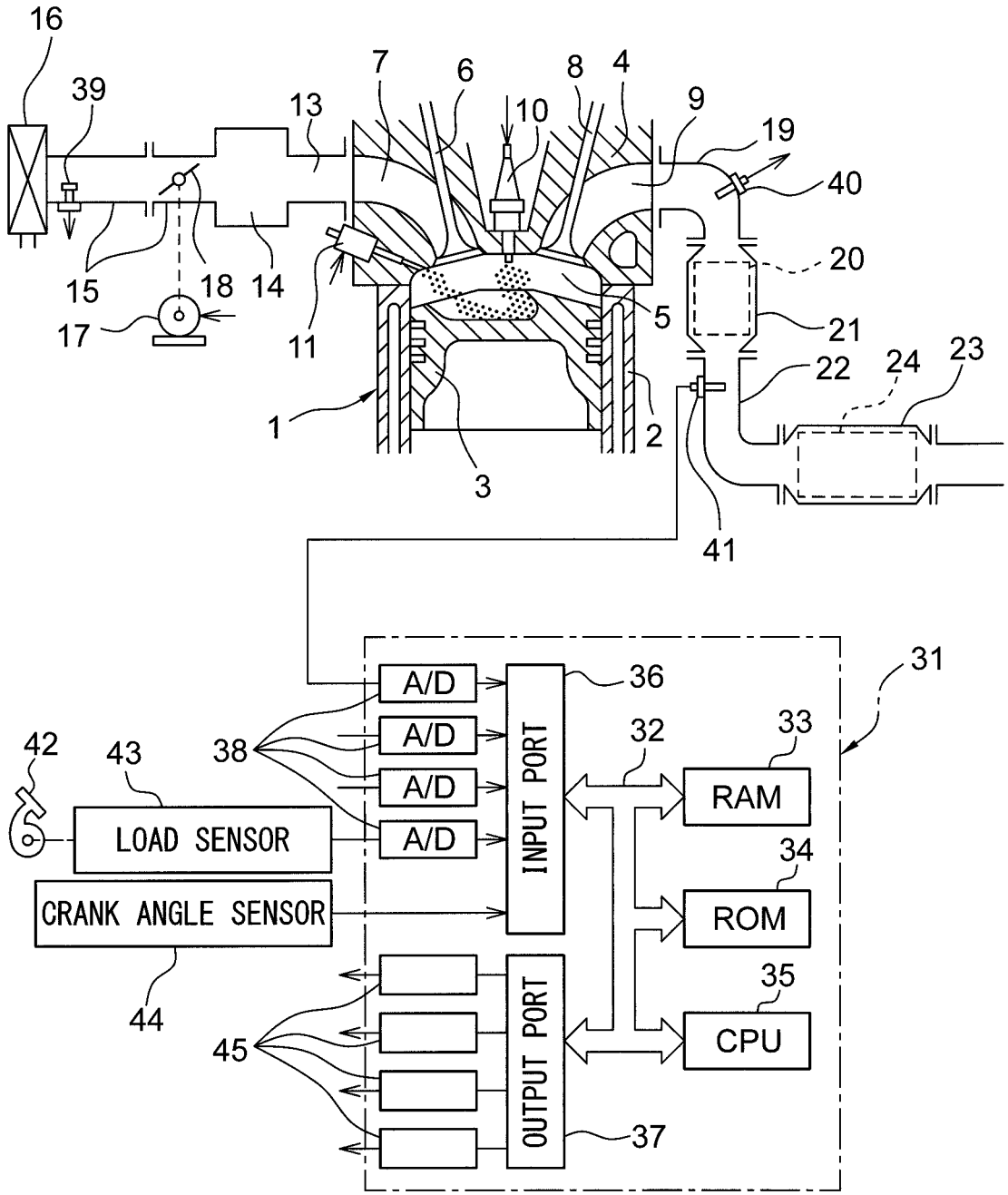
FIG. 1 is a view schematically showing an internal combustion engine in which an exhaust purification system of an internal combustion engine according to a first embodiment of the present invention is provided.

Below, referring to the figures, embodiments of the present invention will be explained in detail. Note that, in the following explanation, similar components are assigned the same reference numerals.

First Embodiment

First, referring to FIG. 1 to FIG. 9, a first embodiment of the present invention will be explained.

<Explanation of Internal Combustion Engine Overall>

FIG. 1 is a view schematically showing an internal combustion engine provided with an exhaust purification system of an internal combustion engine according to a first embodiment of the present invention. The internal combustion engine shown in FIG. 1 is a spark ignition type internal combustion engine. The internal combustion engine is mounted in a vehicle.

Referring to FIG. 1, 1 indicates an engine body, 2 a cylinder block, 3 a piston which reciprocates inside the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, at the center part of the inside wall surface of the cylinder head 4, a spark plug 10 is arranged. A fuel injector 11 is arranged around the inside wall surface of the cylinder head 4. The spark plug 10 is configured to cause generation of a spark in accordance with an ignition signal. Further, the fuel injector 11 injects a predetermined amount of fuel into the combustion chamber 5 in accordance with an injection signal. In the present embodiment, as the fuel, gasoline with a stoichiometric air-fuel ratio of 14.6 is used.

The intake port 7 in each cylinder is connected through a corresponding intake runner 13 to a surge tank 14. The surge tank 14 is connected through an intake pipe 15 to an air cleaner 16. The intake port 7, intake runner 13, surge tank 14, intake pipe 15, etc., form an intake passage which leads air to the combustion chamber 5. Further, inside the intake pipe 15, a throttle valve 18 which is driven by a throttle valve drive actuator 17 is arranged. The throttle valve 18 can be turned by the throttle valve drive actuator 17 to thereby change the opening area of the intake passage.

On the other hand, the exhaust port 9 in each cylinder is connected to an exhaust manifold 19. The exhaust manifold 19 has a plurality of runners which are connected to the exhaust ports 9 and a header at which these runners are collected. The header of the exhaust manifold 19 is connected to an upstream side casing 21 which has an upstream side catalyst 20 built into it. The upstream side casing 21 is connected to a downstream side casing 23 which has a downstream side catalyst 24 built into it via an exhaust pipe 22. The exhaust port 9, exhaust manifold 19, upstream side casing 21, exhaust pipe 22, downstream side casing 23, etc., form an exhaust passage which discharges exhaust gas produced due to combustion of the air-fuel mixture in the combustion chamber 5.

Various control routines of the internal combustion engine are performed by an electronic control unit (ECU) 31. The ECU 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 detecting the flow rate of air which flows through the intake pipe 15 is arranged. The output of the air flow meter 39 is input through a corresponding AD converter 38 to the input port 36.

Further, at the header of the exhaust manifold 19, i.e., a upstream side of the upstream side catalyst 20 in the direction of flow of exhaust, an upstream side air-fuel ratio sensor 40 detecting the air-fuel ratio of the exhaust gas which flows through the inside of the exhaust manifold 19 (that is, the exhaust gas which flows into the upstream side catalyst 20) is arranged. The output of the upstream air-fuel ratio sensor 40 is input through the corresponding AD converter 38 to the input port 36.

Further, inside the exhaust pipe 22, that is, at the downstream side of the upstream side catalyst 20 in the direction of flow of exhaust, a downstream side air-fuel ratio sensor 41 for detecting an air-fuel ratio of the exhaust gas flowing through the inside of the exhaust pipe 22 (that is, exhaust gas flowing out from the upstream side catalyst 20) is arranged. The output of the downstream side air-fuel ratio sensor 41 is input through a corresponding AD converter 38 to the input port 36.

Further, an accelerator pedal 42 is connected to a load sensor 43 generating an output voltage proportional to the amount of depression of the accelerator pedal 42. The output voltage of the load sensor 43 is input through a corresponding AD converter 38 to the input port 36. A crank angle sensor 44 generates an output pulse every time the crankshaft rotates, for example, by 15 degrees. This output pulse is input to the input port 36. In the CPU 35, the engine speed is calculated from the output pulse of the crank angle sensor 44. On the other hand, the output port 37 is connected through corresponding drive circuits 45 to the spark plugs 10, fuel injectors 11, and the throttle valve drive actuator 17.

Note that, the above-mentioned internal combustion engine is a nonsupercharged internal combustion engine fueled by gasoline, but the configuration of the internal combustion engine is not limited to the above configuration. Therefore, the cylinder array, mode of injection of fuel, configuration of the intake and exhaust systems, configuration of the valve operating mechanism, presence of any supercharger, and other specific parts of the configuration of the internal combustion engine may differ from the configuration shown in FIG. 1. For example, the fuel injectors 11 may be arranged to inject fuel into the intake ports 7.

<Explanation of Catalysts>

The upstream side catalyst 20 and the downstream side catalyst 24 arranged in the exhaust passage have similar configurations. The catalysts 20 and 24 are catalysts having oxygen storage abilities, for example, three-way catalysts. Specifically, the catalysts 20 and 24 are comprised of carriers made of ceramic on which a precious metal having a catalytic action (for example, platinum (Pt)) and a co-catalyst having an oxygen storage ability (for example, ceria ($CeO_2$)) are carried.

Figure 2:
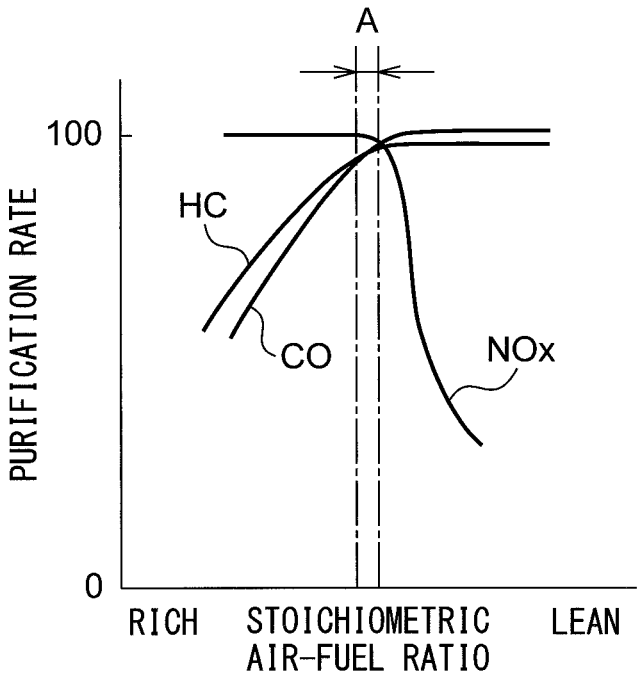
FIG. 2 shows a purification characteristic of a three-way catalyst.

FIG. 2 shows the purification characteristics of a three-way catalyst. As shown in FIG. 2, the purification rates of unburned gas (HC, CO) and nitrogen oxides ($NO_X$) by the catalysts 20 and 24 become extremely high when the air-fuel ratio of the exhaust gas flowing into the catalysts 20 and 24 is in the region near the stoichiometric air-fuel ratio (purification window A in FIG. 2). Therefore, the catalysts 20 and 24 can effectively remove unburned gas and $NO_X$ if the air-fuel ratio of the exhaust gas is maintained at the stoichiometric air-fuel ratio.

Further, the catalysts 20 and 24 store or release oxygen in accordance with the air-fuel ratio of the exhaust gas by the co-catalyst. Specifically, the catalysts 20 and 24 store excess oxygen in the exhaust gas when the air-fuel ratio of the exhaust gas is leaner than the stoichiometric air-fuel ratio. On the other hand, the catalysts 20 and 24 release the amount of additional oxygen required for making the unburned gas oxidize when the air-fuel ratio of the exhaust gas is richer than the stoichiometric air-fuel ratio. As a result, even if the air-fuel ratio of the exhaust gas is somewhat off from the stoichiometric air-fuel ratio, the air-fuel ratio on the surface of the catalysts 20 and 24 is maintained near the stoichiometric air-fuel ratio and the unburned gas and NOx are effectively removed at the catalysts 20 and 24.

Note that, so long as the catalysts 20 and 24 have catalytic actions and oxygen storage abilities, they may be catalysts other than three-way catalysts.

<Output Characteristics of Air-Fuel Ratio Sensors>

Figure 3:
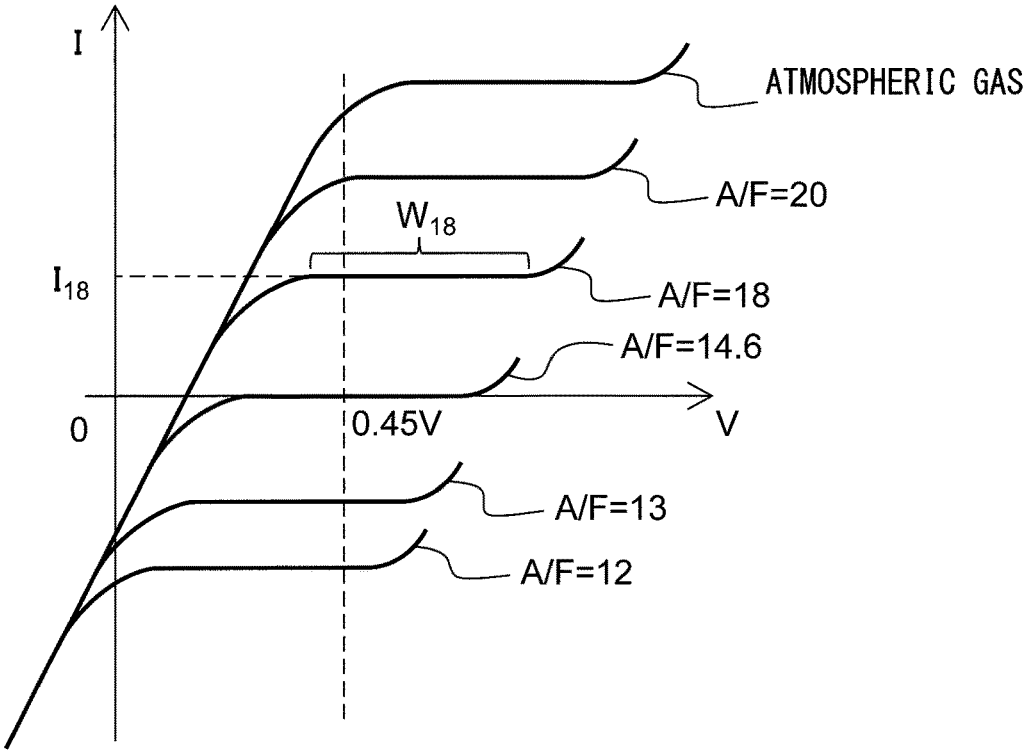
FIG. 3 is a view showing a relationship between a sensor applied voltage and output current at different exhaust air-fuel ratios.
Figure 4:
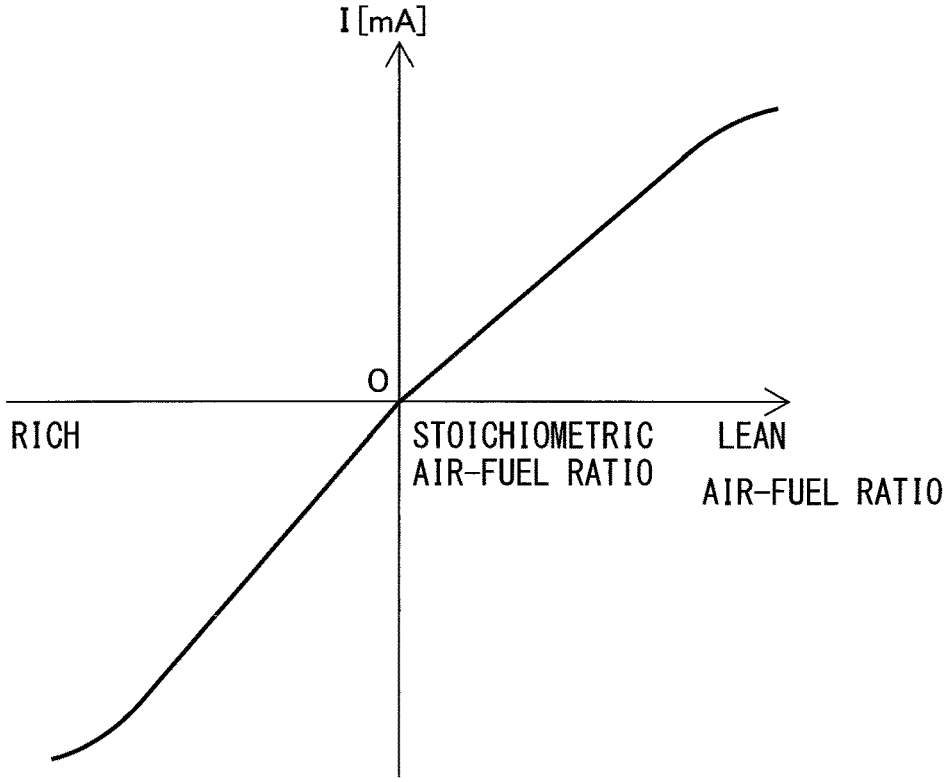
FIG. 4 is a view showing a relationship between an exhaust air-fuel ratio and output current when making a sensor applied voltage constant.

Next, referring to FIG. 3 and FIG. 4, the output characteristics of the air-fuel ratio sensors 40, 41 in the present embodiment will be explained. FIG. 3 is a view showing the voltage-current (V-I) characteristics of the air-fuel ratio sensors 40, 41 in the present embodiment, while FIG. 4 is a view showing the relationship between the air-fuel ratio of the exhaust gas circulating around the air-fuel ratio sensors 40, 41 (below, referred to as the "exhaust air-fuel ratio") and the output current I when maintaining the applied voltage constant. Note that, in the present embodiment, as the air-fuel ratio sensors 40, 41, the same configurations of air-fuel ratio sensors are used.

As will be understood from FIG. 3, in the air-fuel ratio sensors 40, 41 of the present embodiment, the output current I becomes larger the higher the exhaust air-fuel ratio (the leaner). Further, in the V-I line of each exhaust air-fuel ratio, there is a region substantially parallel to the V-axis, that is, a region where the output current does not change much at all even if the applied voltage changes. This voltage region is called the "limit current region". The current at this time is called the "limit current". In FIG. 3, the limit current region and the limit current when the exhaust air-fuel ratio is 18 are respectively shown by $W_{18}$ and $I_{18}$. Therefore, the air-fuel ratio sensors 40, 41 are limit current type air-fuel ratio sensors.

FIG. 4 is a view showing the relationship between the exhaust air-fuel ratio and the output current I when making the applied voltage 0.45V or so. As will be understood from FIG. 4, in the air-fuel ratio sensors 40, 41, the higher the exhaust air-fuel ratio (that is, the leaner), the greater the output current I of the air-fuel ratio sensors 40, 41 becomes. In addition, the air-fuel ratio sensors 40, 41 are configured so that the output current I becomes zero when the exhaust air-fuel ratio is the stoichiometric air-fuel ratio. Accordingly, the air-fuel ratio sensors 40, 41 can continuously (linearly) detect the exhaust air-fuel ratio. Note that, when the exhaust air-fuel ratio becomes larger by a certain extent or more or when it becomes smaller by a certain extent or less, the ratio of the change of the output current with respect to the change of the exhaust air-fuel ratio becomes smaller.

Note that, in the above example, as the air-fuel ratio sensors 40, 41, limit current type air-fuel ratio sensors are used. However, so long as the output current linearly changes with respect to the exhaust air-fuel ratio, as the air-fuel ratio sensors 40, 41, it is also possible to use any other air-fuel ratio sensors such as air-fuel ratio sensors not the limit current type. Further, the air-fuel ratio sensors 40, 41 may also be air-fuel ratio sensors of structures different from each other.

<Exhaust Purification System of Internal Combustion Engine>

Below, an exhaust purification system of an internal combustion engine according to a first embodiment of the present invention (below, simply referred to as the "exhaust purification system") will be explained. The exhaust purification system comprises an upstream side catalyst 20, downstream side catalyst 24, upstream side air-fuel ratio sensor 40, downstream side air-fuel ratio sensor 41, and air-fuel ratio control device. In the present embodiment, the ECU 31 functions as the air-fuel ratio control device.

The air-fuel ratio control device controls the air-fuel ratio of the exhaust gas flowing into the upstream side catalyst 20 (below, referred to as the "inflowing exhaust gas"). Specifically, the air-fuel ratio control device sets the target air-fuel ratio of the inflowing exhaust gas and controls the amount of fuel supplied to the combustion chambers 5 so that the air-fuel ratio of the inflowing exhaust gas matches the target air-fuel ratio. In the present embodiment, the air-fuel ratio control device controls by feedback the amount of fuel supplied to the combustion chambers 5 so that the output air-fuel ratio of the upstream side air-fuel ratio sensor 40 matches the target air-fuel ratio. Note that, "the output air-fuel ratio" means the air-fuel ratio corresponding to the output value of the air-fuel ratio sensor, that is, the air-fuel ratio detected by the air-fuel ratio sensor.

The air-fuel ratio control device alternately switches the target air-fuel ratio of the inflowing exhaust gas between the rich set air-fuel ratio and lean set air-fuel ratio so as to make the oxygen storage amount of the upstream side catalyst 20 fluctuate. Specifically, the air-fuel ratio control device switches the target air-fuel ratio from the rich set air-fuel ratio to the lean set air-fuel ratio when the output air-fuel ratio of the downstream side air-fuel ratio sensor 41 reaches the rich judged air-fuel ratio, and switches the target air-fuel ratio from the lean set air-fuel ratio to the rich set air-fuel ratio when the output air-fuel ratio of the downstream side air-fuel ratio sensor 41 reaches the lean judged air-fuel ratio.

The rich set air-fuel ratio is an air-fuel ratio richer than the stoichiometric air-fuel ratio (in the present embodiment, 14.6) and is, for example, 13 to 14.4. The rich judged air-fuel ratio is an air-fuel ratio richer than the stoichiometric air-fuel ratio and leaner than the rich set air-fuel ratio, for example, is 14.55 to 14.4. The lean set air-fuel ratio is an air-fuel ratio leaner than the stoichiometric air-fuel ratio, for example, is 14.8 to 16.5. The lean judged air-fuel ratio is an air-fuel ratio leaner than the stoichiometric air-fuel ratio and richer than the lean set air-fuel ratio, for example, is 14.65 to 14.8.

When the output air-fuel ratio of the downstream side air-fuel ratio sensor 41 becomes the rich judged air-fuel ratio or less, the oxygen storage amount of the upstream side catalyst 20 could be zero. On the other hand, when the output air-fuel ratio of the downstream side air-fuel ratio sensor 41 becomes the lean judged air-fuel ratio or more, the oxygen storage amount of the upstream side catalyst 20 could be the maximum value. The air-fuel ratio control device can detect the oxygen storage amount of the upstream side catalyst 20 being zero or the maximum value by the output of the downstream side air-fuel ratio sensor 41, so the oxygen storage amount of the upstream side catalyst 20 can be made to fluctuate between zero and the maximum value. By doing this, the oxygen storage ability of the upstream side catalyst 20 can be kept from falling.

In this regard, the air-fuel ratio sensor sometimes gradually deteriorates and changes in gain characteristic along with use. For example, if the gain characteristic of the upstream side air-fuel ratio sensor 40 changes, sometimes the output air-fuel ratio of the upstream side air-fuel ratio sensor 40 and the actual air-fuel ratio of the inflowing exhaust gas deviate from each other. In this case, the output air-fuel ratio of the upstream side air-fuel ratio sensor 40 deviates to the rich side or lean side from the actual air-fuel ratio of the inflowing exhaust gas.

Further, in the unburned gas, hydrogen is fast in speed passing through the diffusion controlling layer of the air-fuel ratio sensor. For this reason, if the concentration of hydrogen in the exhaust gas is high, the output air-fuel ratio of the upstream side air-fuel ratio sensor 40 ends up deviating to the low side (that is, rich side) from the actual air-fuel ratio of the inflowing exhaust gas. If deviation occurs in the output air-fuel ratio of the upstream side air-fuel ratio sensor 40 in this way, the actual air-fuel ratio of the inflowing exhaust gas is liable to deviate from the target air-fuel ratio and the exhaust emission is liable to deteriorate.

For this reason, the air-fuel ratio control device performs the following learning control so as to compensate for any deviation of the output air-fuel ratio of the upstream side air-fuel ratio sensor 40. The air-fuel ratio control device calculates the oxygen storage amount, which is the estimated value of the amount of oxygen stored in the upstream side catalyst 20 while the target air-fuel ratio is maintained at the lean set air-fuel ratio, and the oxygen discharge amount, which is the estimated value of the amount of oxygen discharged from the upstream side catalyst 20 while the target air-fuel ratio is maintained at the rich set air-fuel ratio. The air-fuel ratio control device cumulatively adds the oxygen excess/deficiency to the stoichiometric air-fuel ratio of the inflowing exhaust gas to thereby calculate the oxygen storage amount and the oxygen discharge amount.

Note that, the "oxygen excess/deficiency with respect to the stoichiometric air-fuel ratio of the inflowing exhaust gas" means the amount of oxygen becoming excessive or the amount of oxygen becoming deficient when trying to make the air-fuel ratio of the inflowing exhaust gas the stoichiometric air-fuel ratio. The oxygen excess/deficiency OED is calculated based on, for example, the output of the upstream side air-fuel ratio sensor 40 and the fuel injection amount by the following formula (1).

$$OED=0.23\times(AFup-AFR)\times Qi \quad (1)$$

where, 0.23 is the concentration of oxygen in the air, Qi is the fuel injection amount, AFup is the output air-fuel ratio of the upstream side air-fuel ratio sensor 40, and AFR is the control center air-fuel ratio. The initial value of the control center air-fuel ratio before the later explained learning control is performed is the stoichiometric air-fuel ratio (14.6).

Note that, the oxygen excess/deficiency OED may be calculated based on the output of the upstream side air-fuel ratio sensor 40 and the intake air amount by the following formula (2).

$$OED=0.23\times(AFup-AFR)\times Ga/AFup \quad (2)$$

where, 0.23 is the concentration of oxygen in the air, Ga is the intake air amount, AFup is the output air-fuel ratio of the upstream side air-fuel ratio sensor 40, and AFR is the control center air-fuel ratio. The intake air amount Ga is detected by an air flow meter 39. The initial value of the control center air-fuel ratio before the later explained learning control is performed is the stoichiometric air-fuel ratio (14.6).

When the target air-fuel ratio is maintained at the lean set air-fuel ratio, the upstream side catalyst 20 stores oxygen, so the value of the oxygen excess/deficiency OED becomes positive. The oxygen storage amount is calculated as the cumulative value of the oxygen excess/deficiency calculated when the target air-fuel ratio is maintained at the lean set air-fuel ratio. On the other hand, when the target air-fuel ratio is maintained at the rich set air-fuel ratio, the upstream side catalyst 20 discharges oxygen, so the value of the oxygen excess/deficiency OED becomes negative. The oxygen discharge amount is calculated as the absolute value of the cumulative value of the oxygen excess/deficiency calculated when the target air-fuel ratio is maintained at the rich set air-fuel ratio.

The oxygen storage amount of the upstream side catalyst 20 changes from the maximum value to zero in the period from when the target air-fuel ratio is set to the rich set air-fuel ratio to when it is switched to the lean set air-fuel ratio, that is, in the period when the target air-fuel ratio is maintained at the rich set air-fuel ratio. On the other hand, the oxygen storage amount of the upstream side catalyst 20 changes from zero to the maximum value in the period from when the target air-fuel ratio is set to the lean set air-fuel ratio to when it is switched to the rich set air-fuel ratio, that is, in the period when the target air-fuel ratio is maintained at the lean set air-fuel ratio. For this reason, when accurate air-fuel ratio control is performed, the oxygen storage amount and the oxygen discharge amount should become the same values.

However, the oxygen storage amount and the oxygen discharge amount are calculated based on the output air-fuel ratio of the upstream side air-fuel ratio sensor 40, so if deviation occurs in the output air-fuel ratio of the upstream side air-fuel ratio sensor 40, the oxygen storage amount and the oxygen discharge amount change in accordance with this deviation. If the output air-fuel ratio of the upstream side air-fuel ratio sensor 40 deviates to the rich side, the oxygen storage amount is calculated smaller than the actual oxygen storage amount, and the oxygen discharge amount is calculated larger than the actual oxygen discharge amount. For this reason, the oxygen discharge amount becomes larger than the oxygen storage amount. On the other hand, if the output air-fuel ratio of the upstream side air-fuel ratio sensor 40 deviates to the lean side, the oxygen storage amount is calculated larger than the actual oxygen storage amount, and the oxygen discharge amount is calculated smaller than the actual oxygen discharge amount. For this reason, the oxygen storage amount becomes greater than the oxygen discharge amount.

In the present embodiment, the control center air-fuel ratio is corrected based on the deviation DOA between the oxygen storage amount OSA and the oxygen discharge amount ODA (=ODA−OSA, below, referred to as the "deviation of oxygen amount"). The air-fuel ratio control device calculates the learning value based on the deviation of oxygen amount and corrects the control center air-fuel ratio based on the learning value so that the deviation of oxygen amount becomes smaller.

Specifically, the air-fuel ratio control device updates the learning value sfbg by the following formula (3) and corrects the control center air-fuel ratio AFR by the following formula (4):

$$sfbg(n)=sfbg(n-1)+k_1\times DOA \quad (3)$$

$$AFR=AFRbase-sfbg(n) \quad (4)$$

Note that, in the above formula (3), "n" indicates the number of calculations or the time. Therefore, sfbg(n) indicates the current learning value after a change, while sfbg (n−1) indicates the previous learning value before a change. Further, $k_1$ in the above formula (3) is a gain showing the extent of the amount of updating of the learning value with respect to the deviation of oxygen amount DOA. The larger the value of the gain $k_1$, the greater the amount of change of the learning value with respect to the deviation of oxygen amount DOA. Further, in the above formula (4), the basic control center air-fuel ratio AFRbase is the initial value of the control center air-fuel ratio AFR. In the present embodiment, it is the stoichiometric air-fuel ratio. Further, the initial value sfbg(0) of the learning values is zero.

As will be understood from the above formula (3), when the deviation of oxygen amount DOA is positive, that is, when the oxygen discharge amount ODA is larger than the oxygen storage amount OSA, the learning value is updated so as to decrease. On the other hand, when the deviation of oxygen amount DOA is negative, that is, when the oxygen storage amount OSA is larger than the oxygen discharge amount ODA, the learning value is updated so as to increase.

Further, the target air-fuel ratio of the inflowing exhaust gas is calculated by adding a predetermined air-fuel ratio correction amount to the control center air-fuel ratio AFR. The air-fuel ratio correction amount corresponding to the rich set air-fuel ratio is a negative value, while the air-fuel ratio correction amount corresponding to the lean set air-fuel ratio is a positive value. As will be understood from the above formula (4), if the learning value is positive, the control center air-fuel ratio AFR is made smaller and, as a result, the target air-fuel ratio is corrected to the rich side. On the other hand, if the learning value is negative, the control center air-fuel ratio AFR is made larger and, as a result, the target air-fuel ratio is corrected to the lean side.

However, to keep the exhaust emission from deteriorating while maintaining the oxygen storage ability of the upstream side catalyst 20, sometimes it is desirable to change the condition for switching the target air-fuel ratio (rich judged air-fuel ratio and lean judged air-fuel ratio in the present embodiment). In the present embodiment, if the operating state of the internal combustion engine changes between a first state and a second state, the air-fuel ratio control device changes the condition for switching the target air-fuel ratio between the first state and the second state.

If the rich degree of the rich judged air-fuel ratio becomes larger when the operating state of the internal combustion engine changes from the first state to the second state, at the second state, the timing of switching the target air-fuel ratio from the rich set air-fuel ratio to the lean set air-fuel ratio becomes delayed. As a result, in the second state, the time period during which the target air-fuel ratio is maintained at the rich set air-fuel ratio becomes longer and the oxygen discharge amount becomes greater. Note that, the "rich degree" means the difference between an air-fuel ratio richer than the stoichiometric air-fuel ratio and the stoichiometric air-fuel ratio.

On the other hand, if the lean degree of the lean judged air-fuel ratio becomes larger when the operating state of the internal combustion engine changes from the first state to the second state, at the second state, the timing of switching the target air-fuel ratio from the lean set air-fuel ratio to the rich set air-fuel ratio becomes delayed. As a result, in the second state, the time period during which the target air-fuel ratio is maintained at the lean set air-fuel ratio becomes longer and the oxygen storage amount becomes greater. Note that, the "lean degree" means the difference between an air-fuel ratio leaner than the stoichiometric air-fuel ratio and the stoichiometric air-fuel ratio.

Therefore, if the condition for switching the target air-fuel ratio is changed, even if the output of the upstream side air-fuel ratio sensor 40 is normal, the learning value calculated from the oxygen storage amount and the oxygen discharge amount will sometimes change. As a result, the suitable learning value fluctuates according to the operating state of the internal combustion engine. For this reason, if the learning value is maintained when the operating state of the internal combustion engine changes, the air-fuel ratio of the inflowing exhaust gas is liable to become a value not suitable to the changed operating state and the exhaust emission is liable to deteriorate.

Therefore, in the present embodiment, the air-fuel ratio control device stores the learning value at the time when the operating state of the internal combustion engine changes from the first state to the second state as the first state value, and updates the learning value to the first state value when the operating state of the internal combustion engine returns from the second state to the first state. By doing this, the unsuitable learning value updated in the second state is not used in the first state, so it is possible to keep the exhaust emission from deteriorating after the operating state of the internal combustion engine returns from the second state to the first state. Therefore, if changing the condition for switching the target air-fuel ratio of the inflowing exhaust gas in accordance with the operating state of the internal combustion engine, it is possible to keep the exhaust emission from deteriorating.

Note that, the air-fuel ratio control device, in addition to the above control, may store the learning value when the operating state of the internal combustion engine changes from the second state to the first state as the second state value, and update the learning value to the second state value when the operating state of the internal combustion engine returns from the first state to the second state. By doing this, unsuitable learning value updated in the first state is not used in the second state, so it is possible to keep the exhaust emission from deteriorating after the operating state of the internal combustion engine returns from the first state to the second state.

The operating state of the internal combustion engine changes between the steady state and the nonsteady state. Below, the case where the first state is the nonsteady state while the second state is the steady state will be explained.

To maintain the oxygen storage ability of the upstream side catalyst 20, when making the oxygen storage amount of the upstream side catalyst 20 fluctuate, it is desirable to completely discharge oxygen from the upstream side catalyst 20 and make the upstream side catalyst 20 as a whole store oxygen. To discharge the oxygen stored at the deep part of the upstream side catalyst 20, it is necessary to increase the rich degree of the rich set air-fuel ratio. Further, if increasing the rich degree of the rich judged air-fuel ratio, the time period when the target air-fuel ratio is maintained at the rich set air-fuel ratio becomes longer, so it is possible to reduce the remaining amount of the oxygen stored in the upstream side catalyst 20.

On the other hand, to make the upstream side catalyst 20 store oxygen at its deep part, it is necessary to increase the lean degree of the lean set air-fuel ratio. Further, if increasing the lean degree of the lean judged air-fuel ratio, the time period when the target air-fuel ratio is maintained at the lean set air-fuel ratio becomes longer, so it is possible to increase the amount of oxygen stored in the upstream side catalyst 20.

Further, it is possible to increase the rich degree of at least one of the rich set air-fuel ratio and rich judged air-fuel ratio to thereby periodically supply a predetermined amount of unburned gas to the downstream side catalyst 24. On the other hand, it is possible to increase the lean degree of at least one of the lean set air-fuel ratio and lean judged air-fuel ratio to thereby periodically supply a predetermined amount of oxygen to the downstream side catalyst 24. As a result, it is possible to make the oxygen storage amount of the downstream side catalyst 24 periodically change and in turn possible to keep the oxygen storage ability of the downstream side catalyst 24 from falling.

However, if increasing the rich degree of at least one of the rich set air-fuel ratio and rich judged air-fuel ratio, when the air-fuel ratio of the inflowing exhaust gas temporarily deviates from the target air-fuel ratio due to external disturbance, a large amount of unburned gas is liable to flow out from the upstream side catalyst 20. On the other hand, if increasing the lean degree of at least one of the lean set air-fuel ratio and lean judged air-fuel ratio, when the air-fuel ratio of the inflowing exhaust gas temporarily deviates from the target air-fuel ratio due to external disturbance, a large amount of $NO_X$ is liable to flow out from the upstream side catalyst 20.

The operating state of the internal combustion engine changes between the nonsteady state where the fluctuation of the engine load is large and the steady state where the fluctuation of the engine load is small. At the time of acceleration, deceleration, etc. of the vehicle in which the internal combustion engine is mounted, the operating state of the internal combustion engine becomes the nonsteady state. External disturbance easily occurs when the operating state of the internal combustion engine is a nonsteady state.

For this reason, in the present embodiment, the air-fuel ratio control device changes the condition for switching the target air-fuel ratio between the rich set air-fuel ratio and lean set air-fuel ratio, that is, the values of the rich judged air-fuel ratio and lean judged air-fuel ratio, between the nonsteady state and the steady state. Specifically, the air-fuel ratio control device sets the rich judged air-fuel ratio and lean judged air-fuel ratio to a first rich judged air-fuel ratio and a first lean judged air-fuel ratio when the operating state of the internal combustion engine is a nonsteady state, and sets the rich judged air-fuel ratio and lean judged air-fuel ratio to a second rich judged air-fuel ratio and a second lean judged air-fuel ratio when the operating state of the internal combustion engine is a steady state. The second rich judged air-fuel ratio is richer than the first rich judged air-fuel ratio, while the second lean judged air-fuel ratio is leaner than the first lean judged air-fuel ratio.

Further, the air-fuel ratio control device changes the values of the rich set air-fuel ratio and lean set air-fuel ratio between the nonsteady state and the steady state. Specifically, the air-fuel ratio control device sets the rich set air-fuel ratio and lean set air-fuel ratio to a first rich set air-fuel ratio and a first lean set air-fuel ratio when the operating state of the internal combustion engine is a nonsteady state, and sets the rich set air-fuel ratio and lean set air-fuel ratio to a second rich set air-fuel ratio and a second lean set air-fuel ratio when the operating state of the internal combustion engine is the steady state. The second rich set air-fuel ratio is richer than the first rich set air-fuel ratio, while the second lean set air-fuel ratio is leaner than the first lean set air-fuel ratio.

Due to the above-mentioned control, in the steady state, compared with the nonsteady state, the rich degrees of the rich set air-fuel ratio and rich judged air-fuel ratio are made larger and the lean degrees of the lean set air-fuel ratio and the lean judged air-fuel ratio are made larger. In the steady state, compared with the nonsteady state, the air-fuel ratio of the inflowing exhaust gas is stable. For this reason, by performing such control, it is possible to keep the exhaust emission from deteriorating while keeping the oxygen storage ability of the upstream side catalyst 20 and the downstream side catalyst 24 from dropping.

<Explanation of Air-Fuel Ratio Control Using Time Chart>

Figure 5:
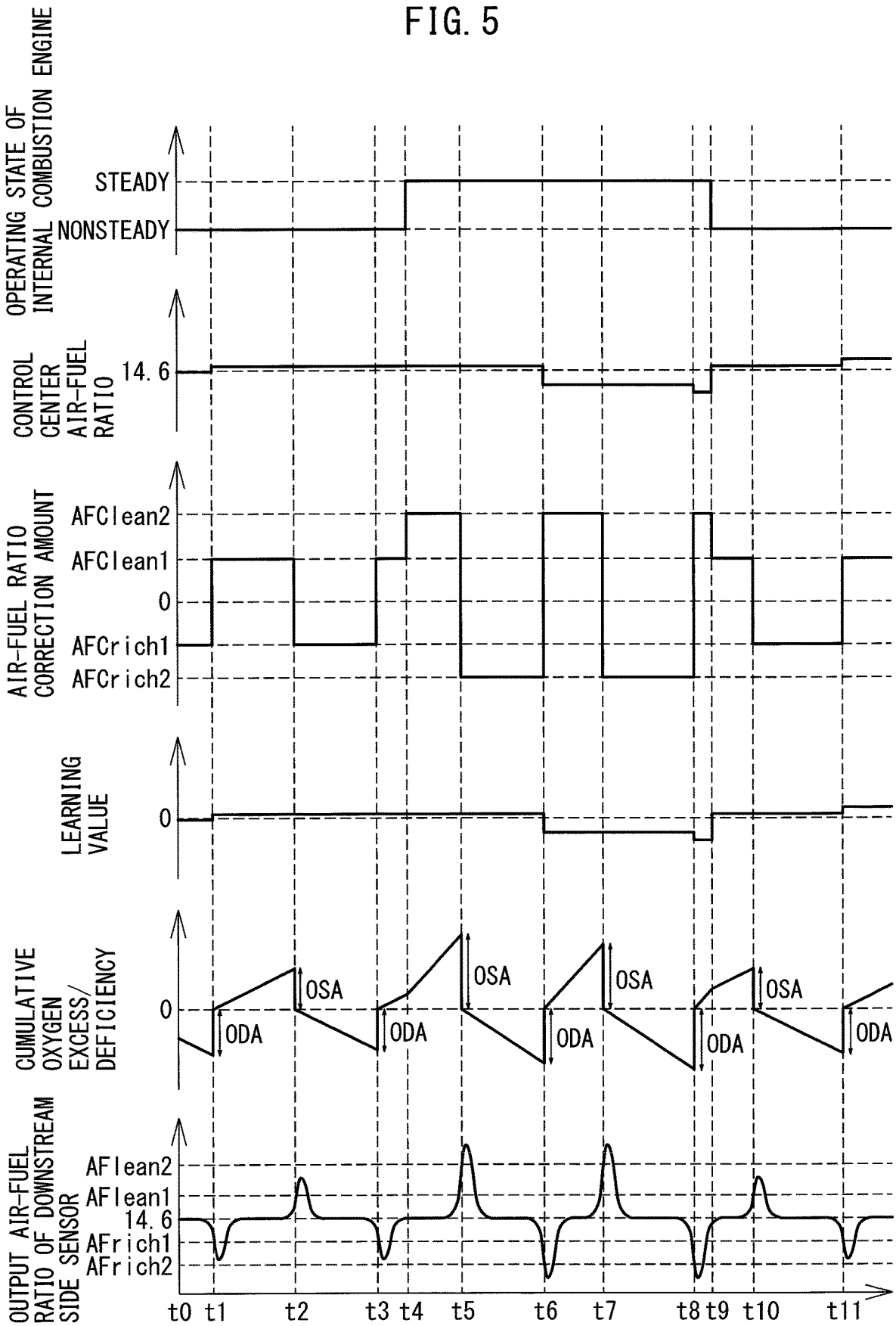
FIG. 5 is a time chart of an operating state of the internal combustion engine etc., when air-fuel ratio control is performed in the first embodiment.

Referring to FIG. 5, the air-fuel ratio control in the present embodiment will be specifically explained. FIG. 5 is a time chart of parameters when the air-fuel ratio control in the first embodiment is performed such as the operating state of the internal combustion engine, control center air-fuel ratio, air-fuel ratio correction amount, learning value, cumulative value of the oxygen excess/deficiency with respect to the stoichiometric air-fuel ratio of the inflowing exhaust gas (cumulative oxygen excess/deficiency), and the output air-fuel ratio of the downstream side air-fuel ratio sensor 41. The cumulative oxygen excess/deficiency is calculated by cumulatively adding the oxygen excess/deficiency calculated by the above formula (1) or (2). Further, the control center air-fuel ratio changes in accordance with the learning value based on the above formula (4). The target air-fuel ratio of the inflowing exhaust gas is calculated by adding the air-fuel ratio correction amount to the control center air-fuel ratio.

In the illustrated example, at the time t0, the operating state of the internal combustion engine is the nonsteady state. In the nonsteady state, the rich correction amount is set to the first rich correction amount AFCrich1 and the lean correction amount is set to the first lean correction amount AFClean1. Further, the rich judged air-fuel ratio is set to the first rich judged air-fuel ratio AFrich1 while the lean judged air-fuel ratio is set to the first lean judged air-fuel ratio AFlean1. The first rich correction amount AFCrich1 corresponds to the first rich set air-fuel ratio, while the first lean correction amount AFClean1 corresponds to the first lean set air-fuel ratio.

Further, at the time to, the air-fuel ratio correction amount is set to the first rich correction amount AFCrich1. The air-fuel ratio of the inflowing exhaust gas becomes richer than the stoichiometric air-fuel ratio. For this reason, the upstream side catalyst 20 discharges an amount of oxygen corresponding to the amount insufficient for oxidizing the unburned gas. The cumulative oxygen excess/deficiency gradually decreases. The outflowing exhaust gas does not contain unburned gas and $NO_X$ due to the purification at the upstream side catalyst 20, so the output air-fuel ratio of the downstream side air-fuel ratio sensor 41 becomes substantially the stoichiometric air-fuel ratio.

If the oxygen storage amount of the upstream side catalyst 20 approaches zero, a part of the unburned gas flowing into the upstream side catalyst 20 starts to flow out from the upstream side catalyst 20. As a result, the output air-fuel ratio of the downstream side air-fuel ratio sensor 41 gradually falls and, at the time t1, reaches the first rich judged air-fuel ratio AFrich1.

To make the oxygen storage amount of the upstream side catalyst 20 increase, at the time t1, the air-fuel ratio correction amount is switched from the first rich correction amount AFCrich1 to the first lean correction amount AFClean1. That is, the target air-fuel ratio is switched from first rich set air-fuel ratio to the first lean set air-fuel ratio. Further, at the time t1, the learning value is updated and the cumulative value of the oxygen excess/deficiency is reset to zero. In this example, the oxygen discharge amount ODA is larger than the oxygen storage amount OSA (not shown), so the learning value is made larger.

If the air-fuel ratio of the inflowing exhaust gas becomes leaner than the stoichiometric air-fuel ratio, the upstream side catalyst 20 stores the excess oxygen in the inflowing exhaust gas and the cumulative oxygen excess/deficiency gradually increases. For this reason, after the time t1, along with the increase in the oxygen storage amount of the upstream side catalyst 20, the air-fuel ratio of the outflowing exhaust gas changes from an air-fuel ratio richer than the stoichiometric air-fuel ratio to the stoichiometric air-fuel ratio, and the output air-fuel ratio of the downstream side air-fuel ratio sensor 41 converges to the stoichiometric air-fuel ratio.

After that, if the oxygen storage amount of the upstream side catalyst 20 approaches the maximum oxygen storage amount, a part of the oxygen and $NO_X$ flowing into the upstream side catalyst 20 starts to flow out from the upstream side catalyst 20. As a result, the output air-fuel ratio of the downstream side air-fuel ratio sensor 41 becomes gradually higher. At the time t2, it reaches the first lean judged air-fuel ratio AFlean1.

To cause the oxygen storage amount of the upstream side catalyst 20 to decrease, at the time t2, the air-fuel ratio correction amount is switched from the first lean correction amount AFClean1 to the first rich correction amount AFCrich1. That is, the target air-fuel ratio is switched from the first lean set air-fuel ratio to the first rich set air-fuel ratio. Further, at this time, the cumulative value of the oxygen excess/deficiency is reset to zero.

In the same way as the time t1, at the time t3, the output air-fuel ratio of the downstream side air-fuel ratio sensor 41 reaches the first rich judged air-fuel ratio AFrich1. For this reason, at the time t3, the air-fuel ratio correction amount is switched from the first rich correction amount AFCrich1 to the first lean correction amount AFClean1. That is, the target air-fuel ratio is switched from the first rich set air-fuel ratio to the first lean set air-fuel ratio. Further, at the time t3, the learning value is updated and the cumulative value of the oxygen excess/deficiency is reset to zero. In this example, the oxygen storage amount OSA at the time t1 to the time t2 and the oxygen discharge amount ODA at the time t2 to the time t3 are almost the same, so the learning value does not change much at all.

After that, at the time t4, the operating state of the internal combustion engine changes from the nonsteady state to the steady state. At the steady state, the rich correction amount is set to the second rich correction amount AFCrich2 while the lean correction amount is set to the second lean correction amount AFClean2. The second rich correction amount AFCrich2 is smaller than the first rich correction amount AFCrich1, while the second lean correction amount AFClean2 is larger than the first lean correction amount AFClean1. The second rich correction amount AFCrich2 corresponds to the second rich set air-fuel ratio while the second lean correction amount AFClean2 corresponds to the second lean set air-fuel ratio.

Further, in the steady state, the rich judged air-fuel ratio is set to the second rich judged air-fuel ratio AFrich2, while the lean judged air-fuel ratio is set to the second lean judged air-fuel ratio AFlean2. The second rich judged air-fuel ratio AFrich2 is richer than the first rich judged air-fuel ratio AFrich1, while the second lean judged air-fuel ratio AFlean2 is leaner than the first lean judged air-fuel ratio AFlean1.

For this reason, at the time t4, the air-fuel ratio correction amount is switched from the first lean correction amount AFClean1 to the second lean correction amount AFClean2. That is, the target air-fuel ratio is switched from the first lean set air-fuel ratio to the second lean set air-fuel ratio. Further, at the time t4, the learning value of the time when the operating state of the internal combustion engine changes from the nonsteady state to the steady state is stored.

After that, at the time t5, the output air-fuel ratio of the downstream side air-fuel ratio sensor 41 reaches the second lean judged air-fuel ratio AFlean2. For this reason, the air-fuel ratio correction amount is switched from the second lean correction amount AFClean2 to the second rich correction amount AFCrich2. That is, the target air-fuel ratio is switched from the second lean set air-fuel ratio to the second rich set air-fuel ratio. Further, at this time, the cumulative value of the oxygen excess/deficiency is reset to zero.

At the time t6, the output air-fuel ratio of the downstream side air-fuel ratio sensor 41 reaches the second rich judged air-fuel ratio AFrich2. For this reason, at the time t6, the air-fuel ratio correction amount is switched from the second rich correction amount AFCrich2 to the second lean correction amount AFClean2. That is, the target air-fuel ratio is switched from the second rich set air-fuel ratio to the second lean set air-fuel ratio. Further, at the time t6, the learning value is updated and the cumulative value of the oxygen excess/deficiency is reset to zero.

In this example, in the steady state, to reliably supply oxygen to the downstream side catalyst 24, the lean degree of the second lean judged air-fuel ratio AFlean2 is made larger than the rich degree of the second rich judged air-fuel ratio AFrich2. For this reason, the oxygen storage amount OSA at the time t3 to the time t5 becomes larger than the oxygen discharge amount ODA of the time t5 to the time t6 and the learning value is made smaller.

At the time t7, the output air-fuel ratio of the downstream side air-fuel ratio sensor 41 reaches the second lean judged air-fuel ratio AFlean2. For this reason, the air-fuel ratio correction amount is switched from the second lean correction amount AFClean2 to the second rich correction amount AFCrich2. That is, the target air-fuel ratio is switched from the second lean set air-fuel ratio to the second rich set air-fuel ratio. Further, at this time, the cumulative value of the oxygen excess/deficiency is reset to zero.

At the time t8, the output air-fuel ratio of the downstream side air-fuel ratio sensor 41 reaches the second rich judged air-fuel ratio AFrich2. For this reason, at the time t8, the air-fuel ratio correction amount is switched from the second rich correction amount AFCrich2 to the second lean correction amount AFClean2. That is, the target air-fuel ratio is switched from the second rich set air-fuel ratio to the second lean set air-fuel ratio. Further, at the time t8, the learning value is updated and the cumulative value of the oxygen excess/deficiency is reset to zero.

Due to the updating of the learning value at the time t6, the difference between the oxygen storage amount OSA of the time t6 to the time t7 and the oxygen discharge amount ODA of the time t7 to the time t8 becomes smaller. However, the oxygen storage amount OSA at the time t6 to the time t7 is slightly larger than the oxygen discharge amount ODA of the time t7 to the time t8, so the learning value is made slightly smaller at the time t8.

After that, at the time t9, the operating state of the internal combustion engine changes from the steady state to the nonsteady state. For this reason, the air-fuel ratio correction amount is switched from the second lean correction amount AFClean2 to the first lean correction amount AFClean1. That is, the target air-fuel ratio is switched from the second lean set air-fuel ratio to the first lean set air-fuel ratio. Further, at the time t9, the learning value is updated to the learning value stored at the time t4.

At the time t10, the output air-fuel ratio of the downstream side air-fuel ratio sensor 41 reaches the first lean judged air-fuel ratio AFlean1. For this reason, the air-fuel ratio correction amount is switched from the first lean correction amount AFClean1 to the first rich correction amount AFCrich1. That is, the target air-fuel ratio is switched from the first lean set air-fuel ratio to the first rich set air-fuel ratio. Further, at this time, the cumulative value of the oxygen excess/deficiency is reset to zero.

At the time t11, the output air-fuel ratio of the downstream side air-fuel ratio sensor 41 reaches the first rich judged air-fuel ratio AFrich1. For this reason, at the time t11, the air-fuel ratio correction amount is switched from the first rich correction amount AFCrich1 to the first lean correction amount AFClean1. That is, the target air-fuel ratio is switched from the first rich set air-fuel ratio to the first lean set air-fuel ratio. Further, at the time t11, the learning value is updated and the cumulative value of the oxygen excess/deficiency is reset to zero. In this example, the oxygen discharge amount ODA at the time t10 to the time t11 is larger than the oxygen storage amount OSA of the time t8 to the time t10, so the learning value is made larger.

<Block Diagram of Control>

Figure 6:
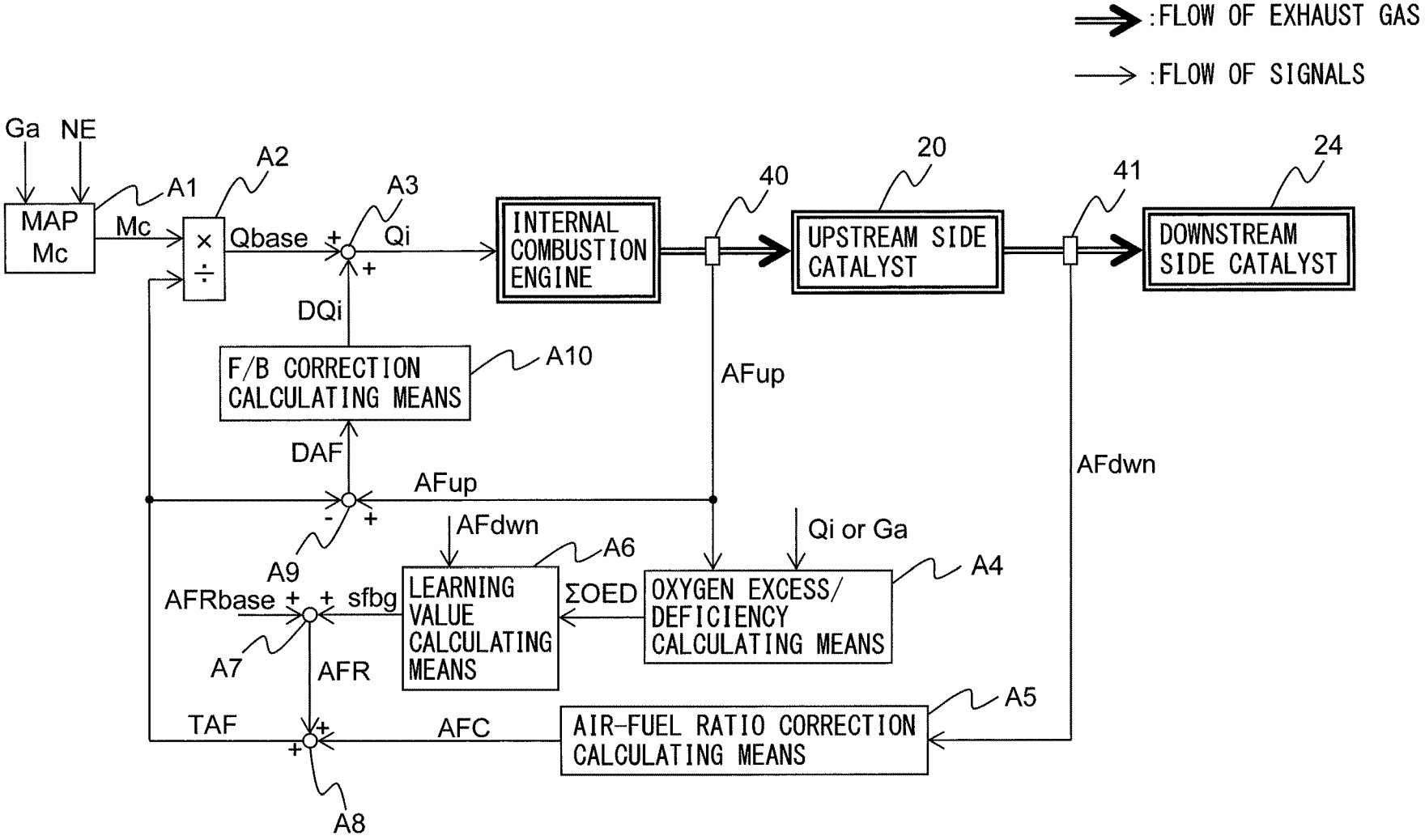
FIG. 6 is a control block diagram of air-fuel ratio control.

Below, referring to FIG. 6 to FIG. 9, the air-fuel ratio control in the present embodiment will be explained in detail. FIG. 6 is a block diagram of control of the air-fuel ratio control. The air-fuel ratio control device includes the functional blocks A1 to A10. Below, the functional blocks will be explained.

First, the calculation of the fuel injection amount will be explained. To calculate the fuel injection amount, a cylinder intake air calculating means A1, basic fuel injection calculating means A2, and fuel injection calculating means A3 are used.

The cylinder intake air calculating means A1 calculates the intake air amount Mc to the cylinders based on the intake air amount Ga, the engine speed NE, and the map or calculation formula stored in the ROM 34 of the ECU 31. The intake air amount Ga is detected by the air flow meter 39, while the engine speed NE is calculated based on the output of the crank angle sensor 44.

The basic fuel injection calculating means A2 divides the cylinder intake air amount Mc calculated by the cylinder intake air calculating means A1 by the target air-fuel ratio TAF to calculate the basic fuel injection amount Qbase (Qbase=Mc/TAF). The target air-fuel ratio TAF is calculated by the later explained target air-fuel ratio setting means A8.

The fuel injection calculating means A3 adds the later explained F/B correction amount DQi to the basic fuel injection amount Qbase calculated by the basic fuel injection calculating means A2 to calculate the fuel injection amount Qi (Qi=Qbase+DQi). An instruction for injection is issued to the fuel injectors 11 so that fuel of the thus calculated fuel injection amount Qi is injected from the fuel injectors 11.

Next, calculation of the target air-fuel ratio will be explained. To calculate the target air-fuel ratio, the oxygen excess/deficiency calculating means A4, air-fuel ratio correction calculating means A5, learning value calculating means A6, control center air-fuel ratio calculating means A7, and target air-fuel ratio setting means A8 are used.

The oxygen excess/deficiency calculating means A4 calculates the oxygen excess/deficiency by the above formula (1) or (2) based on the output air-fuel ratio AFup of the upstream side air-fuel ratio sensor 40, the fuel injection amount Qi calculated by the fuel injection calculating means A3, or the intake air amount Ga. Further, the oxygen excess/deficiency calculating means A4 cumulatively adds the oxygen excess/deficiency to calculate the cumulative oxygen excess/deficiency ΣOED.

In the air-fuel ratio correction calculating means A5, the air-fuel ratio correction amount AFC of the target air-fuel ratio is calculated based on the output air-fuel ratio AFdwn of the downstream side air-fuel ratio sensor 41. Specifically, the air-fuel ratio correction amount AFC is calculated based on the flow chart shown in FIG. 9.

In the learning value calculating means A6, the learning value sfbg is calculated based on the output air-fuel ratio AFdwn of the downstream side air-fuel ratio sensor 41, the cumulative oxygen excess/deficiency ΣOED calculated by the oxygen excess/deficiency calculating means A4, etc. Specifically, the learning value sfbg is calculated based on the flow chart shown in FIG. 8.

At the control center air-fuel ratio calculating means A7, the control center air-fuel ratio AFR is calculated based on the basic control center air-fuel ratio AFRbase (in the present embodiment, stoichiometric air-fuel ratio) and the learning value sfbg calculated by the learning value calculating means A6. Specifically, as shown by the above formula (4), the control center air-fuel ratio AFR is calculated by subtracting the learning value sfbg from the basic control center air-fuel ratio AFRbase.

The target air-fuel ratio setting means A8 adds the air-fuel ratio correction amount AFC calculated by the air-fuel ratio correction calculating means A5 to the control center air-fuel ratio AFR calculated by the control center air-fuel ratio calculating means A7 to calculate the target air-fuel ratio TAF. The thus calculated target air-fuel ratio TAF is input to the basic fuel injection calculating means A2 and later explained air-fuel ratio deviation calculating means A9.

Next, the calculation of the F/B correction amount based on the output air-fuel ratio AFup of the upstream side air-fuel ratio sensor 40 will be explained. To calculate the F/B correction amount, the air-fuel ratio deviation calculating means A9 and F/B correction calculating means A10 are used.

The air-fuel ratio deviation calculating means A9 subtracts the target air-fuel ratio TAF calculated by the target air-fuel ratio setting means A8 from the output air-fuel ratio AFup of the upstream side air-fuel ratio sensor 40 to calculate the deviation of air-fuel ratio DAF (DAF=AFup−TAF). This deviation of air-fuel ratio DAF is a value showing the excess or deficiency of the amount of supply of fuel with respect to the target air-fuel ratio TAF.

The F/B correction calculating means A10 processes the deviation of air-fuel ratio DAF calculated by the air-fuel ratio deviation calculating means A9 by proportional integral differential processing (PID processing) to calculate the F/B correction amount DQi for compensating for the excess or deficiency of the amount of supply of fuel based on the following formula (5). The thus calculated F/B correction amount DQi is input to the fuel injection calculating means A3.

$$DQi = Kp \cdot DAF + Ki \cdot SDAF + Kd \cdot DDAF \quad (5)$$

Note that, in the above formula (5), Kp is a preset proportional gain (proportional constant), Ki is the preset integral gain (integral constant), and Kd is the preset differential gain (differential constant). Further, DDAF is the time differential of the deviation of air-fuel ratio DAF and is calculated by dividing the difference between the currently updated deviation of air-fuel ratio DAF and the previous deviation of air-fuel ratio DAF by the time corresponding to the updating interval. Further, SDAF is the time integral of the deviation of air-fuel ratio DAF and is calculated by adding the currently updated deviation of air-fuel ratio DAF to the previous time integral SDAF.

<Processing for Setting Control Condition>

Figure 7:
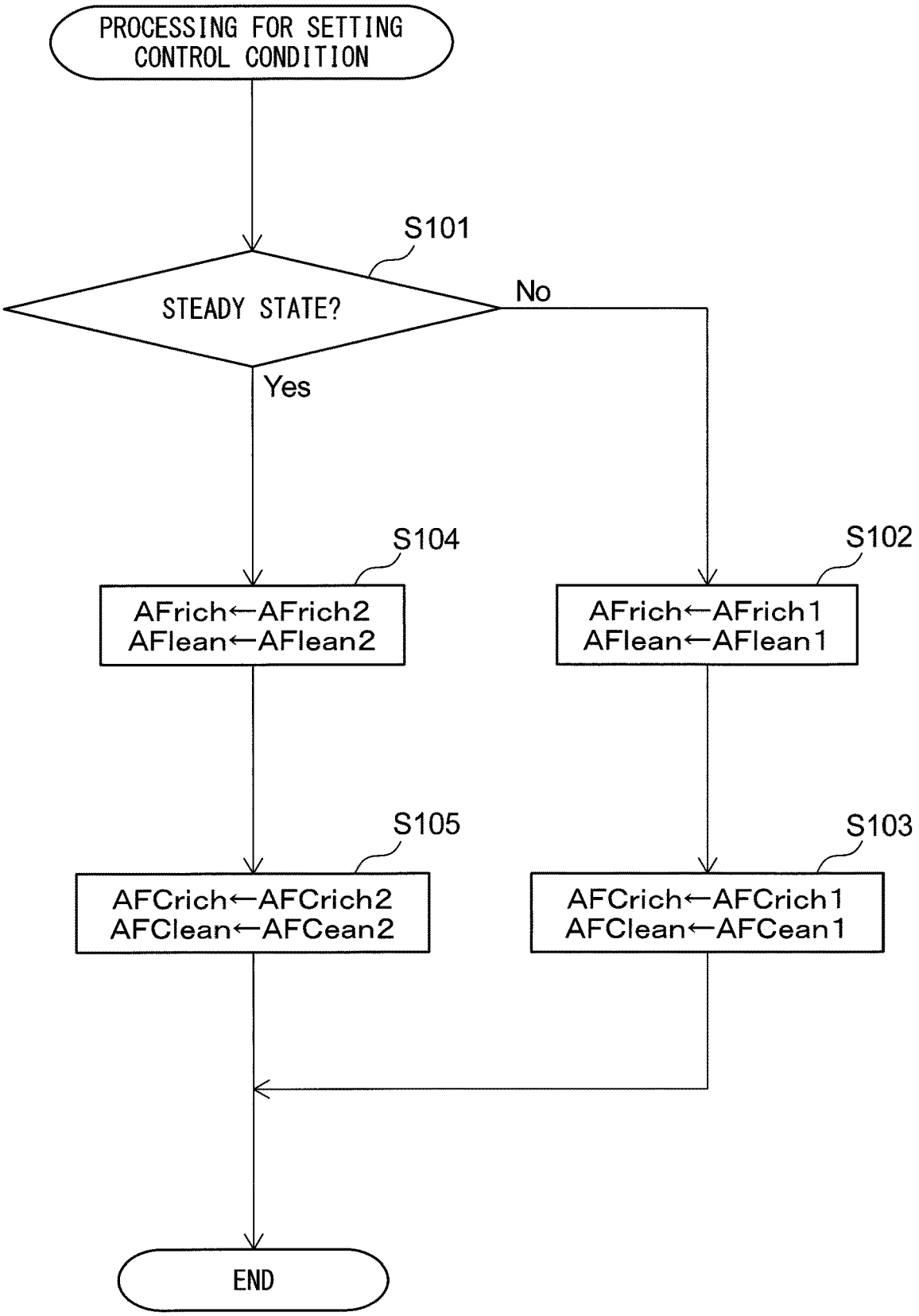
FIG. 7 is a flow chart showing a control routine of processing for setting a control condition in the first embodiment.

FIG. 7 is a flow chart showing a control routine of processing for setting a control condition in the first embodiment. The control routine is repeatedly performed at predetermined time intervals by the ECU 31 after startup of the internal combustion engine.

First, at step S101, it is judged whether the operating state of the internal combustion engine is the steady state. For example, when the amount of change of the engine load per unit time is a predetermined value or less, it is judged that the internal combustion engine is the steady state, while when the amount of change of the engine load per unit time is larger than the predetermined value, it is judged that the internal combustion engine is the nonsteady state. The engine load is detected by the load sensor 43. Further, when the amount of change of the intake air amount of the internal combustion engine per unit time is a predetermined value or less, it may be judged that the internal combustion engine is in the steady state, while when the amount of change of the intake air amount of the internal combustion engine per unit time is larger than the predetermined value, it may be judged that the internal combustion engine is in the nonsteady state. The intake air amount is detected by the air flow meter 39.

If at step S101 it is judged that the operating state of the internal combustion engine is the nonsteady state, the present control routine proceeds to step S102. At step S102, the rich judged air-fuel ratio AFrich is set to the first rich judged air-fuel ratio AFrich1 while the lean judged air-fuel ratio AFlean is set to the first lean judged air-fuel ratio AFlean1. Next, at step S103, the rich correction amount AFCrich is set to the first rich correction amount AFCrich1 while the lean correction amount AFClean is set to the first lean correction amount AFClean1. That is, the rich set air-fuel ratio is set to the first rich set air-fuel ratio while the lean set air-fuel ratio is set to the first lean set air-fuel ratio. After step S103, the present control routine ends.

On the other hand, if at step S101 it is judged that the operating state of the internal combustion engine is the steady state, the present control routine proceeds to step S104. At step S104, the rich judged air-fuel ratio AFrich is set to the second rich judged air-fuel ratio AFrich2 while the lean judged air-fuel ratio AFlean is set to the second lean judged air-fuel ratio AFlean2. Next, at step S105, the rich correction amount AFCrich is set to the second rich correction amount AFCrich2 while the lean correction amount AFClean is set to the second lean correction amount AFClean2. That is, the rich set air-fuel ratio is set to the second rich set air-fuel ratio, while the lean set air-fuel ratio is set to the second lean set air-fuel ratio. After step S105, the present control routine ends.

Note that, the value of any one of the rich judged air-fuel ratio AFrich and lean judged air-fuel ratio AFlean may be changed between the steady state and the nonsteady state. Further, the value of any one of the rich correction amount AFCrich and lean correction amount AFClean may be changed between the steady state and the nonsteady state. Further, the rich correction amount AFCrich and lean correction amount AFClean need not be changed between the steady state and the nonsteady state. In this case, step S103 and step S105 are omitted.

Further, the rich judged air-fuel ratio AFrich, lean judged air-fuel ratio AFlean, rich correction amount AFCrich, and lean correction amount AFClean need not be switched at the timing when the operating state of the internal combustion engine changes between the steady state and the nonsteady state. For example, these switching operations may be performed at the timing when the target air-fuel ratio is switched after the operating state of the internal combustion engine changes between the steady state and the nonsteady state.

<Processing for Updating Learning Value>

Figure 8:
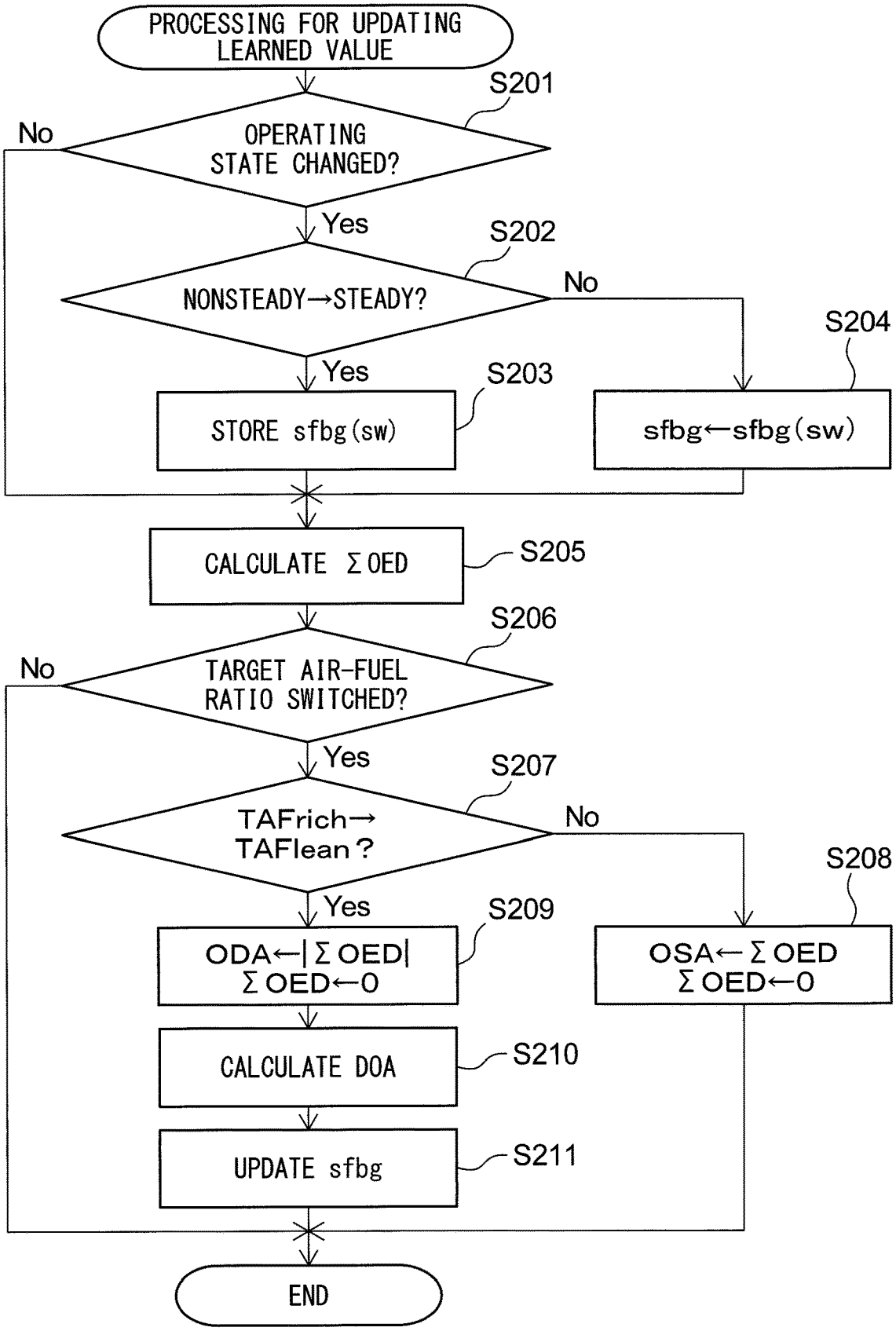
FIG. 8 is a flow chart showing a control routine of processing for updating a learning value in the first embodiment.

FIG. 8 is a flow chart showing a control routine of processing for updating the learning value in the first embodiment. The control routine is repeatedly performed at predetermined time intervals by the ECU 31 after startup of the internal combustion engine.

First, at step S201, it is judged whether the operating state of the internal combustion engine has changed between the steady state and the nonsteady state in the period from when step S201 was performed at the previous control routine to when step S201 is performed at the current control routine. If it is judged that the operating state of the internal combustion engine has not changed, the present control routine proceeds to step S205.

At step S205, the cumulative oxygen excess/deficiency ΣOED is calculated. The cumulative oxygen excess/deficiency ΣOED is calculated by cumulatively adding the oxygen excess/deficiency calculated at the above formula (1) or (2). Next, at step S206, it is judged whether the target air-fuel ratio has been switched in the period from when step S206 was performed at the previous control routine to when step S206 is performed at the current control routine. If it is judged that the target air-fuel ratio has not been switched, the present control routine ends. On the other hand, if it is judged that the target air-fuel ratio has been switched, the present control routine proceeds to step S207.

At step S207, it is judged whether target air-fuel ratio has been switched from the rich set air-fuel ratio TAFrich to the lean set air-fuel ratio TAFlean. If it is judged that the target air-fuel ratio has been switched from the lean set air-fuel ratio TAFlean to the rich set air-fuel ratio TAFrich, the present control routine proceeds to step S208. At step S208, the oxygen storage amount OSA is updated to the value of the cumulative oxygen excess/deficiency ΣOED. After that, the cumulative oxygen excess/deficiency ΣOED is reset to zero. After step S208, the present control routine ends.

On the other hand, if at step S207 it is judged that the target air-fuel ratio has been switched from the rich set air-fuel ratio TAFrich to the lean set air-fuel ratio TAFlean, the present control routine proceeds to step S209. At step S209, the oxygen discharge amount ODA is updated to the absolute value of the cumulative oxygen excess/deficiency ΣOED. After that, the cumulative oxygen excess/deficiency ΣOED is reset to zero.

Next, at step S210, the deviation of oxygen amount DOA is calculated by subtracting the oxygen storage amount OSA from the oxygen discharge amount ODA. Next, at step S211, the learning value sfbg is updated based on the deviation of oxygen amount DOA by the above formula (3). After step S211, the present control routine ends.

Further, if at step S201 it is judged that the operating state of the internal combustion engine has changed, the present control routine proceeds to step S202. At step S202, it is judged whether the operating state of the internal combustion engine has changed from the nonsteady state to the steady state. If it is judged that the operating state of the internal combustion engine has changed from the nonsteady state to the steady state, the present control routine proceeds to step S203. At step S203, the learning value sfbg(sw) at the time when the operating state of the internal combustion engine changes from the nonsteady state to the steady state is stored.

On the other hand, if it is judged at step S202 that the operating state of the internal combustion engine has changed from the steady state to the nonsteady state, the present control routine proceeds to step S204. At step S204, the learning value sfbg is updated to the learning value sfbg(sw) stored at step S203.

Note that, step S210 and step S211 may be performed after step S208. Further, at step S203, the learning value sfbg(sw1) at the time when the operating state of the internal combustion engine has changed from the nonsteady state to the steady state may be stored, at step S204, the learning value sfbg may be updated to the learning value sfbg(sw1), at step S204, the learning value sfbg(sw2) at the time when the operating state of the internal combustion engine changes from the steady state to the nonsteady state may be stored, and, at step S203, the learning value sfbg may be changed to the learning value sfbg(sw2). Further, in this example, the first state is the nonsteady state while the second state is the steady state, but the first state may be the steady state and the second state may be the nonsteady state. In this case, at step S202, it is judged whether the operating state of the internal combustion engine has changed from the steady state to the nonsteady state.

<Processing for Setting Target Air-Fuel Ratio>

Figure 9:
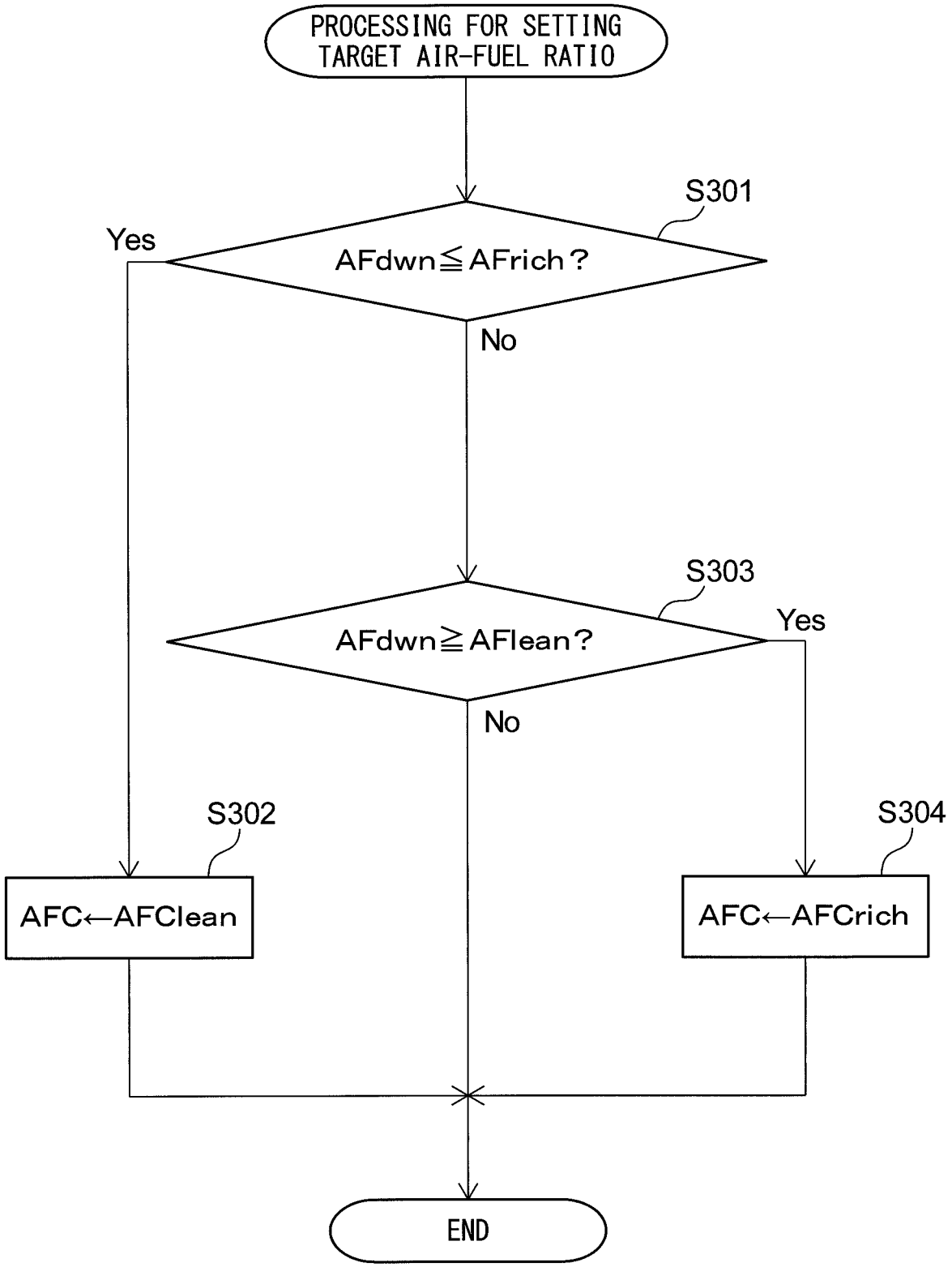
FIG. 9 is a flow chart showing a control routine of processing for setting a target air-fuel ratio in the first embodiment.

FIG. 9 is a flow chart showing a control routine of processing for setting a target air-fuel ratio in the first embodiment. The control routine is repeatedly performed at predetermined time intervals by the ECU 31 after startup of the internal combustion engine.

First, at step S301, it is judged whether the output air-fuel ratio AFdwn of the downstream side air-fuel ratio sensor 41 is the rich judged air-fuel ratio AFrich or less. The rich judged air-fuel ratio AFrich is set at step S102 or step S104 of FIG. 7.

If at step S301 it is judged that the output air-fuel ratio AFdwn of the downstream side air-fuel ratio sensor 41 is the rich judged air-fuel ratio AFrich or less, the present control routine proceeds to step S302. At step S302, the air-fuel ratio correction amount AFC is set to the lean correction amount AFClean. That is, the target air-fuel ratio is set to the lean set air-fuel ratio. The lean correction amount AFClean is set at step S103 or step S105 of FIG. 7.

On the other hand, if at step S301 it is judged that the output air-fuel ratio AFdwn of the downstream side air-fuel ratio sensor 41 is higher than the rich judged air-fuel ratio AFrich, the present control routine proceeds to step S303. At step S303, it is judged whether the output air-fuel ratio AFdwn of the downstream side air-fuel ratio sensor 41 is the lean judged air-fuel ratio AFlean or more. The lean judged air-fuel ratio AFlean is set at step S102 or step S104 of FIG. 7.

If at step S303 it is judged that the output air-fuel ratio AFdwn of the downstream side air-fuel ratio sensor 41 is the lean judged air-fuel ratio AFlean or more, the present control routine proceeds to step S304. At step S304, the air-fuel ratio correction amount AFC is set to the rich correction amount AFCrich. That is, the target air-fuel ratio is set to the rich set air-fuel ratio. The rich correction amount AFCrich is set at step S103 or step S105 of FIG. 7. After step S304, the present control routine ends.

On the other hand, if at step S303 it is judged that the output air-fuel ratio AFdwn of the downstream side air-fuel ratio sensor 41 is less than the lean judged air-fuel ratio AFlean, the present control routine ends. In this case, the air-fuel ratio correction amount AFC is maintained at the currently set value.

Second Embodiment

The constitution and control of the exhaust purification system of an internal combustion engine in a second embodiment are basically similar to the exhaust purification system of an internal combustion engine in the first embodiment except for the points explained below. For this reason, below, the second embodiment of the present invention will be explained focusing on the parts different from the first embodiment.

The air-fuel ratio control device can detect the oxygen storage amount of the upstream side catalyst 20 being zero or the maximum value by the output of the downstream side air-fuel ratio sensor 41, so the oxygen storage amount of the upstream side catalyst 20 can be made to fluctuate between zero and the maximum value. However, due to the effect of the hydrogen or ammonia discharged from the upstream side catalyst 20, the output air-fuel ratio of the downstream side air-fuel ratio sensor 41 sometimes becomes richer than the actual air-fuel ratio. In this case, the time until the output air-fuel ratio of the downstream side air-fuel ratio sensor 41 becomes the lean judged air-fuel ratio or more becomes longer and the timing of switching the target air-fuel ratio from the lean set air-fuel ratio to the rich set air-fuel ratio becomes delayed. As a result, while the target air-fuel ratio is set to the lean set air-fuel ratio, a large amount of $NO_X$ is liable to flow out from the catalyst and the exhaust emission is liable to deteriorate.

Therefore, in the second embodiment, the air-fuel ratio control device switches the target air-fuel ratio from the lean set air-fuel ratio to the rich set air-fuel ratio when the oxygen storage amount reaches the threshold value if the oxygen storage amount reaches the threshold value before the output air-fuel ratio of the downstream side air-fuel ratio sensor 41 reaches the lean judged air-fuel ratio. By doing this, it is possible to keep a large amount of $NO_X$ from flowing out from the upstream side catalyst 20 in the period during which the target air-fuel ratio is set to the lean set air-fuel ratio due to the effects of the hydrogen or ammonia discharged from the upstream side catalyst 20.

The air-fuel ratio control device updates the threshold value based on the oxygen storage amount and the oxygen discharge amount. For example, the air-fuel ratio control device calculates the maximum oxygen storage amount Cmax based on the oxygen storage amount OSA and the oxygen discharge amount ODA by the following formula (6) and calculates the threshold value OEDth based on the maximum oxygen storage amount Cmax by the following formula (7):

$$Cmax=(OSA+ODA)/2 \quad (6)$$

$$OEDth=Cmax\times A \quad (7)$$

The coefficient A is a value larger than 1, for example, is 1.1 to 1.5, preferably 1.2. The threshold value OEDth is a value larger than the maximum oxygen storage amount Cmax, so when the oxygen storage amount OSA reaches the threshold value OEDth, it may be considered that the actual oxygen storage amount of the upstream side catalyst 20 is reaching the maximum value.

As explained above, if the condition for switching the target air-fuel ratio between the first state and the second state of the operating state of the internal combustion engine is changed, at least one of the oxygen storage amount and the oxygen discharge amount fluctuate. As a result, as will be understood from the above formulas (6) and (7), the threshold value will fluctuate according to the operating state of the internal combustion engine. For this reason, if the threshold value is maintained when the operating state of the internal combustion engine changes, the threshold value is liable to become a value not suited to the changed operating state and the exhaust emission is liable to deteriorate.

Therefore, in the second embodiment, the air-fuel ratio control device stores the threshold value at the time when the operating state of the internal combustion engine changes from the first state to the second state as the first state threshold value, and updates the threshold value to the first state threshold value when the operating state of the internal combustion engine returns from the second state to the first state. By doing this, the unsuitable threshold value updated at the second state is not used in the first state, so it is possible to keep the exhaust emission from deteriorating after the operating state of the internal combustion engine returns from the second state to the first state.

Note that, the air-fuel ratio control device, in addition to the above control, may store the threshold value of the time when the operating state of the internal combustion engine changes from the second state to the first state as the second state threshold value and update the threshold value to the second state threshold value when the operating state of the internal combustion engine returns from the first state to the second state. By doing this, the unsuitable threshold value updated at the first state is not used in the second state, so it is possible to keep the exhaust emission from deteriorating after the operating state of the internal combustion engine returns from the first state to the second state.

<Processing for Updating Threshold Value>

Below, the air-fuel ratio control in the second embodiment will be explained in detail. In the following example, the first state is the nonsteady state while the second state is the steady state. In the second embodiment, in addition to the control routines for the processing for setting the control condition of FIG. 7 and the processing for updating the learning value of FIG. 8, the control routine for the processing for updating the threshold value is performed.

Figure 10:
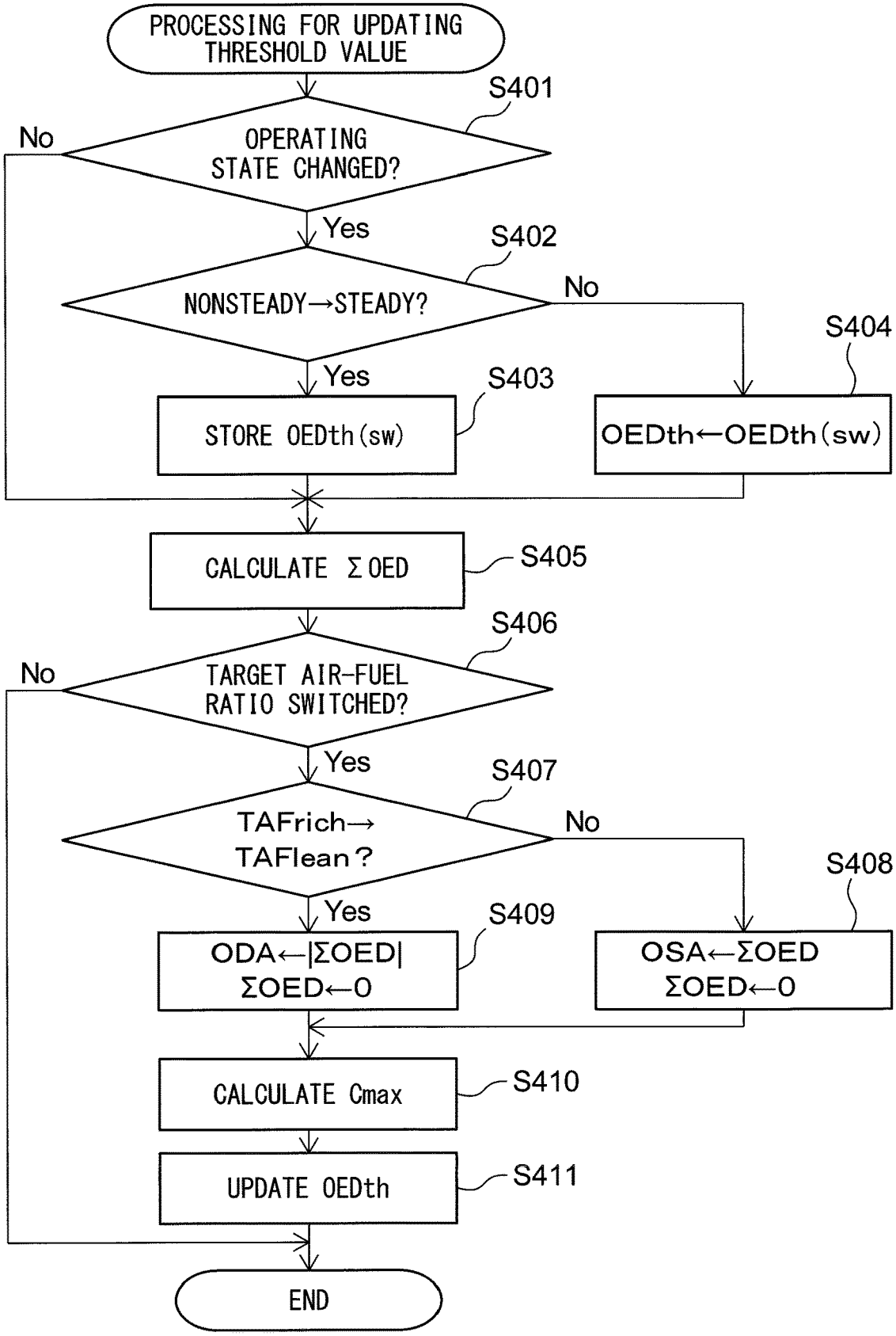
FIG. 10 is a flow chart showing a control routine of processing for updating a threshold value in a second embodiment.

FIG. 10 is a flow chart showing a control routine of processing for updating the threshold value in the second embodiment. The control routine is repeatedly performed at predetermined time intervals by the ECU 31 after startup of the internal combustion engine.

First, at step S401, it is judged whether the operating state of the internal combustion engine changed between the steady state and the nonsteady state in the period from when step S401 was performed at the previous control routine to when step S401 is performed at the current control routine. If it is judged that the operating state of the internal combustion engine has not changed, the present control routine proceeds to step S405.

At step S405, the cumulative oxygen excess/deficiency ΣOED is calculated. The cumulative oxygen excess/deficiency ΣOED is calculated by cumulatively adding the oxygen excess/deficiency calculated by the above formula (1) or (2). Next, at step S406, it is judged whether the target air-fuel ratio has been switched in the period from when step S406 was performed at the previous control routine to when step S406 is performed at the current control routine. If it is judged that the target air-fuel ratio has not been switched, the present control routine ends. On the other hand, if it is judged that the target air-fuel ratio has been switched, the present control routine proceeds to step S407.

At step S407, it is judged whether the target air-fuel ratio has been switched from the rich set air-fuel ratio TAFrich to the lean set air-fuel ratio TAFlean. If it is judged that the target air-fuel ratio has been switched from the lean set air-fuel ratio TAFlean to the rich set air-fuel ratio TAFrich, the present control routine proceeds to step S408. At step S408, the oxygen storage amount OSA is updated to the value of the cumulative oxygen excess/deficiency ΣOED. After that, the cumulative oxygen excess/deficiency ΣOED is reset to zero.

On the other hand, if at step S407 it is judged that the target air-fuel ratio has been switched from the rich set air-fuel ratio TAFrich to the lean set air-fuel ratio TAFlean, the present control routine proceeds to step S409. At step S409, the oxygen discharge amount ODA is updated to the absolute value of the cumulative value ΣOED of the oxygen excess/deficiency. After that, the cumulative oxygen excess/deficiency ΣOED is reset to zero.

After step S408 or step S409, at step S410, the maximum oxygen storage amount Cmax of the upstream side catalyst 20 is calculated by the above formula (6). Note that, the maximum oxygen storage amount Cmax may be calculated as the oxygen discharge amount ODA or oxygen storage amount OSA.

Next, at step S411, the threshold value OEDth is updated based on the maximum oxygen storage amount Cmax by the above formula (7). After step S411, the present control routine ends.

Further, if at step S401 it is judged that the operating state of the internal combustion engine has changed, the present control routine proceeds to step S402. At step S402, it is judged whether the operating state of the internal combustion engine has changed from the nonsteady state to the steady state. If it is judged that the operating state of the internal combustion engine has changed from the nonsteady state to the steady state, the present control routine proceeds to step S403. At step S403, the threshold value OEDth(sw) of the time when the operating state of the internal combustion engine changes from the nonsteady state to the steady state is stored.

On the other hand, if at step S402 it is judged that the operating state of the internal combustion engine has changed from the steady state to the nonsteady state, the present control routine proceeds to step S404. At step S404, the threshold value OEDth is updated to the threshold value OEDth(sw) stored at step S403.

Note that at step S403 the threshold value OEDth(sw1) at the time when the operating state of the internal combustion engine changes from the nonsteady state to the steady state may be stored, at step S404, the threshold value OEDth may be updated to the threshold value OEDth(sw1), at step S404 the threshold value OEDth(sw2) at the time when the operating state of the internal combustion engine changes from the steady state to the nonsteady state may be stored, and, at step S403, the threshold value OEDth may be updated to the threshold value OEDth(sw2). Further, in this example, the first state is the nonsteady state while the second state is the steady state, but the first state may be the steady state and the second state may be the nonsteady state. In this case, at step S402, it is judged whether the operating state of the internal combustion engine has changed from the steady state to the nonsteady state.

<Processing for Setting Target Air-Fuel Ratio>

Figure 11:
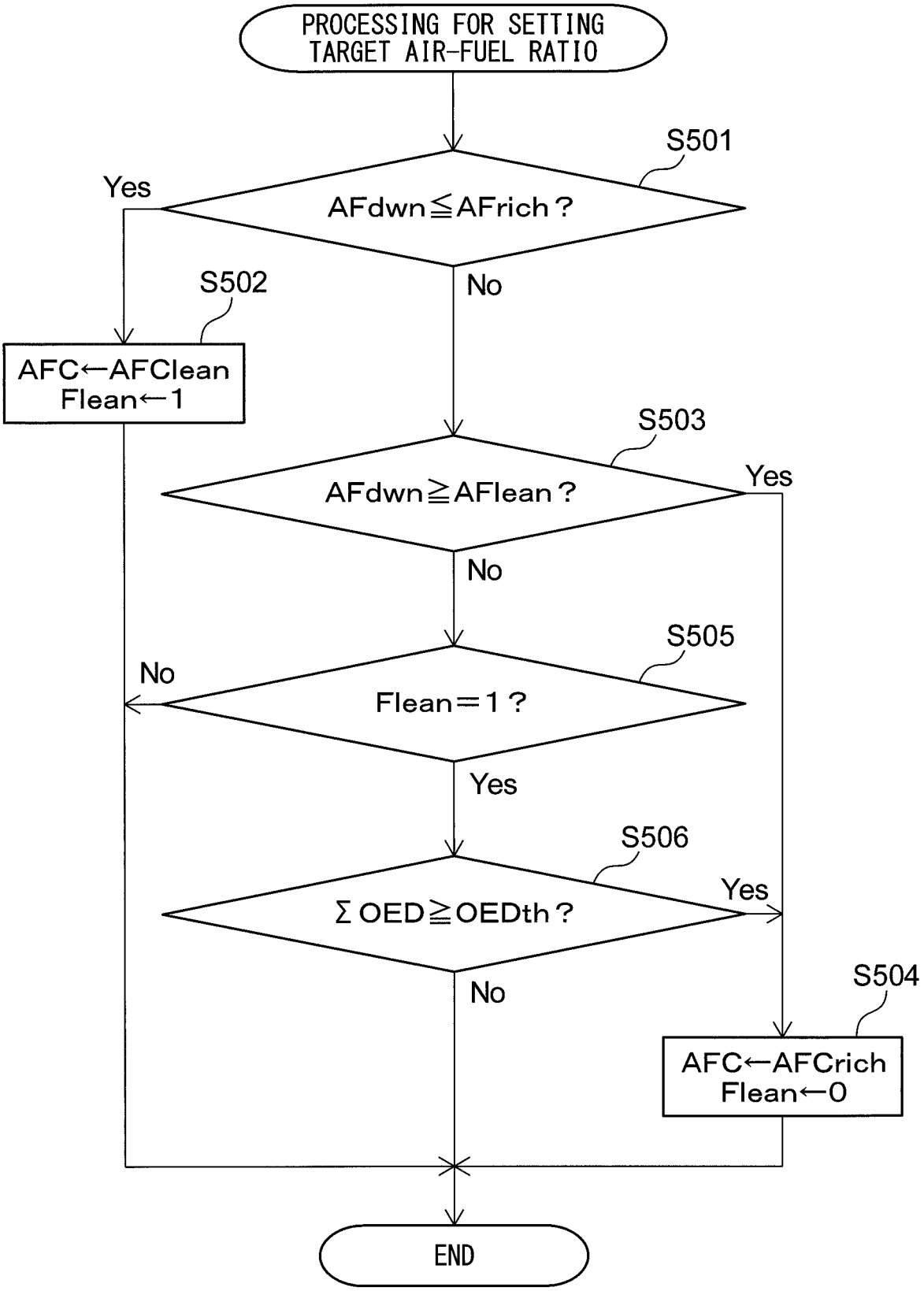
FIG. 11 is a flow chart showing a control routine of processing for setting a target air-fuel ratio in the second embodiment.

FIG. 11 is a flow chart showing a control routine of processing for setting the target air-fuel ratio in the second embodiment. The control routine is repeatedly performed at predetermined time intervals by the ECU 31 after startup of the internal combustion engine.

First, at step S501, it is judged whether the output air-fuel ratio AFdwn of the downstream side air-fuel ratio sensor 41 is the rich judged air-fuel ratio AFrich or less. The rich judged air-fuel ratio AFrich is set at step S102 or step S104 of FIG. 7. If at step S501 it is judged that the output air-fuel ratio AFdwn of the downstream side air-fuel ratio sensor 41 is the rich judged air-fuel ratio AFrich or less, the present control routine proceeds to step S502.

At step S502, the air-fuel ratio correction amount AFC is set to the lean correction amount AFClean. That is, the target air-fuel ratio is set to the lean set air-fuel ratio. The lean correction amount AFClean is set at step S103 or step S105 of FIG. 7. Further, at step S502, the lean flag Flean is set to "1". The lean flag Flean is a flag which is set to "1" when the target air-fuel ratio is set to the lean set air-fuel ratio and is set to zero when the target air-fuel ratio is set to the rich set air-fuel ratio.

On the other hand, if at step S501 it is judged that the output air-fuel ratio AFdwn of the downstream side air-fuel ratio sensor 41 is higher than the rich judged air-fuel ratio AFrich, the present control routine proceeds to step S503. At step S503, it is judged whether the output air-fuel ratio AFdwn of the downstream side air-fuel ratio sensor 41 is the lean judged air-fuel ratio AFlean or more. The lean judged air-fuel ratio AFlean is set at step S102 or step S104 of FIG. 7.

If at step S503 it is judged that the output air-fuel ratio AFdwn of the downstream side air-fuel ratio sensor 41 is the lean judged air-fuel ratio AFlean or more, the present control routine proceeds to step S504. At step S504, the air-fuel ratio correction amount AFC is set to the rich correction amount AFCrich. That is, the target air-fuel ratio is set to the rich set air-fuel ratio. The rich correction amount AFCrich is set at step S103 or step S105 of FIG. 7. Further, at step S504, the lean flag Flean is set to zero. After step S504, the present control routine ends.

On the other hand, if at step S503 it is judged that the output air-fuel ratio AFdwn of the downstream side air-fuel ratio sensor 41 is less than the lean judged air-fuel ratio AFlean, the present control routine proceeds to step S505. At step S505, it is judged whether the lean flag Flean is "1". If it is judged that the lean flag Flean is zero, the present control routine ends. In this case, the air-fuel ratio correction amount AFC is maintained at the currently set value.

On the other hand, if at step S505 it is judged that the lean flag Flean is "1", the present control routine proceeds to step S506. At step S506, it is judged whether the cumulative oxygen excess/deficiency ΣOED is the threshold value OEDth or more. The threshold value OEDth is set at the control routine of FIG. 10. The cumulative oxygen excess/deficiency ΣOED is calculated by cumulatively adding the oxygen excess/deficiency calculated by the above formula (1) or (2). Note that, the cumulative oxygen excess/deficiency ΣOED calculated when the target air-fuel ratio is set to the lean set air-fuel ratio corresponds to the oxygen storage amount. Further, the cumulative oxygen excess/deficiency ΣOED is reset to zero at step S408 or step S409 of FIG. 10.

If at S506 it is judged that the cumulative oxygen excess/deficiency ΣOED is less than the threshold value OEDth, the present control routine ends. In this case, the air-fuel ratio correction amount AFC is maintained at the currently set value.

On the other hand, if at S506 it is judged that the cumulative oxygen excess/deficiency ΣOED is the threshold value OEDth or more, the present control routine proceeds to step S504. At step S504, the air-fuel ratio correction amount AFC is set to the rich correction amount AFCrich and the lean flag Flean is set to zero. After step S504, the present control routine ends.

Third Embodiment

The constitution and control of the exhaust purification system of an internal combustion engine in a third embodiment are basically similar to the exhaust purification system of an internal combustion engine in the first embodiment except for the points explained below. For this reason, below, the third embodiment of the present invention will be explained focusing on the parts different from the first embodiment.

In the third embodiment, the air-fuel ratio control device switches the target air-fuel ratio from the rich set air-fuel ratio to the lean set air-fuel ratio when the output air-fuel ratio of the downstream side air-fuel ratio sensor 41 reaches the rich judged air-fuel ratio and switches the target air-fuel ratio from the lean set air-fuel ratio to the rich set air-fuel ratio when the oxygen storage amount reaches a switched storage amount smaller than the maximum oxygen storage amount. Due to this control, since basically the oxygen storage amount of the upstream side catalyst 20 will not reach the maximum oxygen storage amount, it is possible to keep $NO_X$ from flowing out from the upstream side catalyst 20.

Further, the air-fuel ratio control device changes the condition for switching the target air-fuel ratio, that is, the value of at least one of the rich judged air-fuel ratio and switched storage amount, between the first state and the second state. For example, the air-fuel ratio control device sets the rich judged air-fuel ratio and the switched storage amount to a first rich judged air-fuel ratio and a first switched storage amount when the operating state of the internal combustion engine is a nonsteady state, and sets the rich judged air-fuel ratio and the switched storage amount to a second rich judged air-fuel ratio and a second switched storage amount when the operating state of the internal combustion engine is the steady state. The second rich judged air-fuel ratio is richer than the first rich judged air-fuel ratio, while the second switched storage amount is greater than the first switched storage amount.

Further, the air-fuel ratio control device changes the values of the rich set air-fuel ratio and lean set air-fuel ratio between the nonsteady state and the steady state. For example, the air-fuel ratio control device sets the rich set air-fuel ratio and the lean set air-fuel ratio to a first rich set air-fuel ratio and a first lean set air-fuel ratio when the operating state of the internal combustion engine is a nonsteady state, and sets the rich set air-fuel ratio and the lean set air-fuel ratio to a second rich set air-fuel ratio and a second lean set air-fuel ratio when the operating state of the internal combustion engine is the steady state. The second rich set air-fuel ratio is richer than the first rich set air-fuel ratio, while the second lean set air-fuel ratio is leaner than the first lean set air-fuel ratio.

<Processing for Setting Control Condition>

Figure 12:
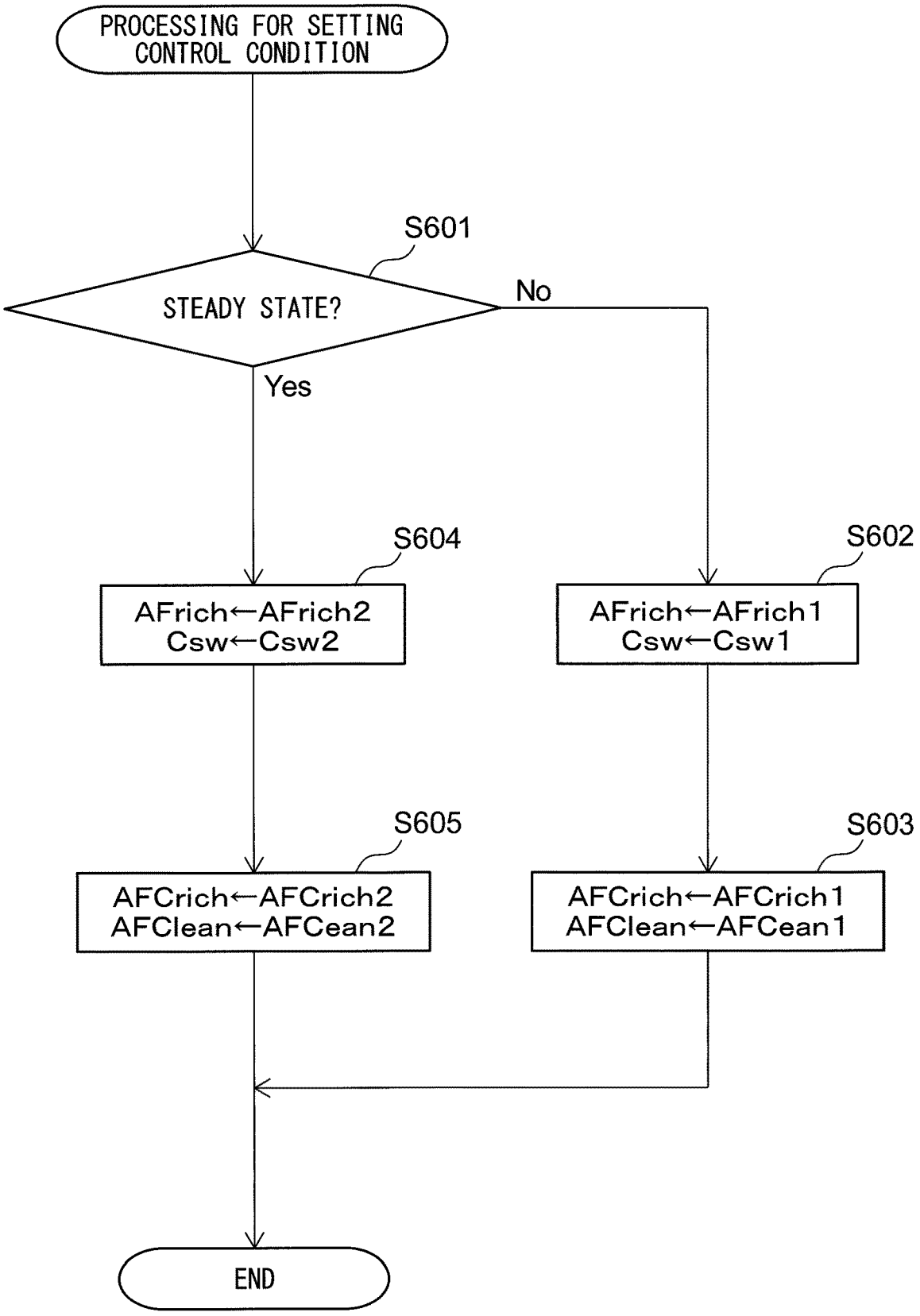
FIG. 12 is a flow chart showing a control routine of processing for setting a control condition in a third embodiment.

FIG. 12 is a flow chart showing a control routine of processing for setting a control condition in the third embodiment. The control routine is repeatedly performed at predetermined time intervals by the ECU 31 after startup of the internal combustion engine.

First, at step S601, in the same way as step S101 of FIG. 7, it is judged whether the operating state of the internal combustion engine is the steady state. If it is judged that the operating state of the internal combustion engine is a nonsteady state, the present control routine proceeds to step S602. At step S602, the rich judged air-fuel ratio AFrich is set to the first rich judged air-fuel ratio AFrich1 and the switched storage amount Csw is set to the first switched storage amount Csw1. Next, at step S603, the rich correction amount AFCrich is set to the first rich correction amount AFCrich1 while the lean correction amount AFClean is set to the first lean correction amount AFClean1. That is, the rich set air-fuel ratio is set to the first rich set air-fuel ratio while the lean set air-fuel ratio is set to the first lean set air-fuel ratio. After step S603, the present control routine ends.

On the other hand, if at step S601 it is judged that the operating state of the internal combustion engine is the steady state, the present control routine proceeds to step S604. At step S604, the rich judged air-fuel ratio AFrich is set to the second rich judged air-fuel ratio AFrich2 while the switched storage amount Csw is set to the second switched storage amount Csw2. Next, at step S605, the rich correction amount AFCrich is set to the second rich correction amount AFCrich2, while the lean correction amount AFClean is set to the second lean correction amount AFClean2. That is, the rich set air-fuel ratio is set to the second rich set air-fuel ratio while the lean set air-fuel ratio is set to the second lean set air-fuel ratio. After step S605, the present control routine ends.

Note that, only the value of the rich judged air-fuel ratio AFrich may be changed between the steady state and the nonsteady state. Further, only the value of one of the rich correction amount AFCrich and lean correction amount AFClean may be changed between the steady state and the nonsteady state. Further, the rich correction amount AFCrich and lean correction amount AFClean need not be changed between the steady state and the nonsteady state. In this case, step S603 and step S605 are omitted.

Further, the rich judged air-fuel ratio AFrich, switched storage amount Cref, rich correction amount AFCrich, and lean correction amount AFClean need not be switched at the timing when the operating state of the internal combustion engine changes between the steady state and nonsteady state. For example, these switching operations may be performed at timings where the target air-fuel ratio is switched after the operating state of the internal combustion engine changes between the steady state and the nonsteady state.

<Processing for Setting Target Air-Fuel Ratio>

Figure 13:
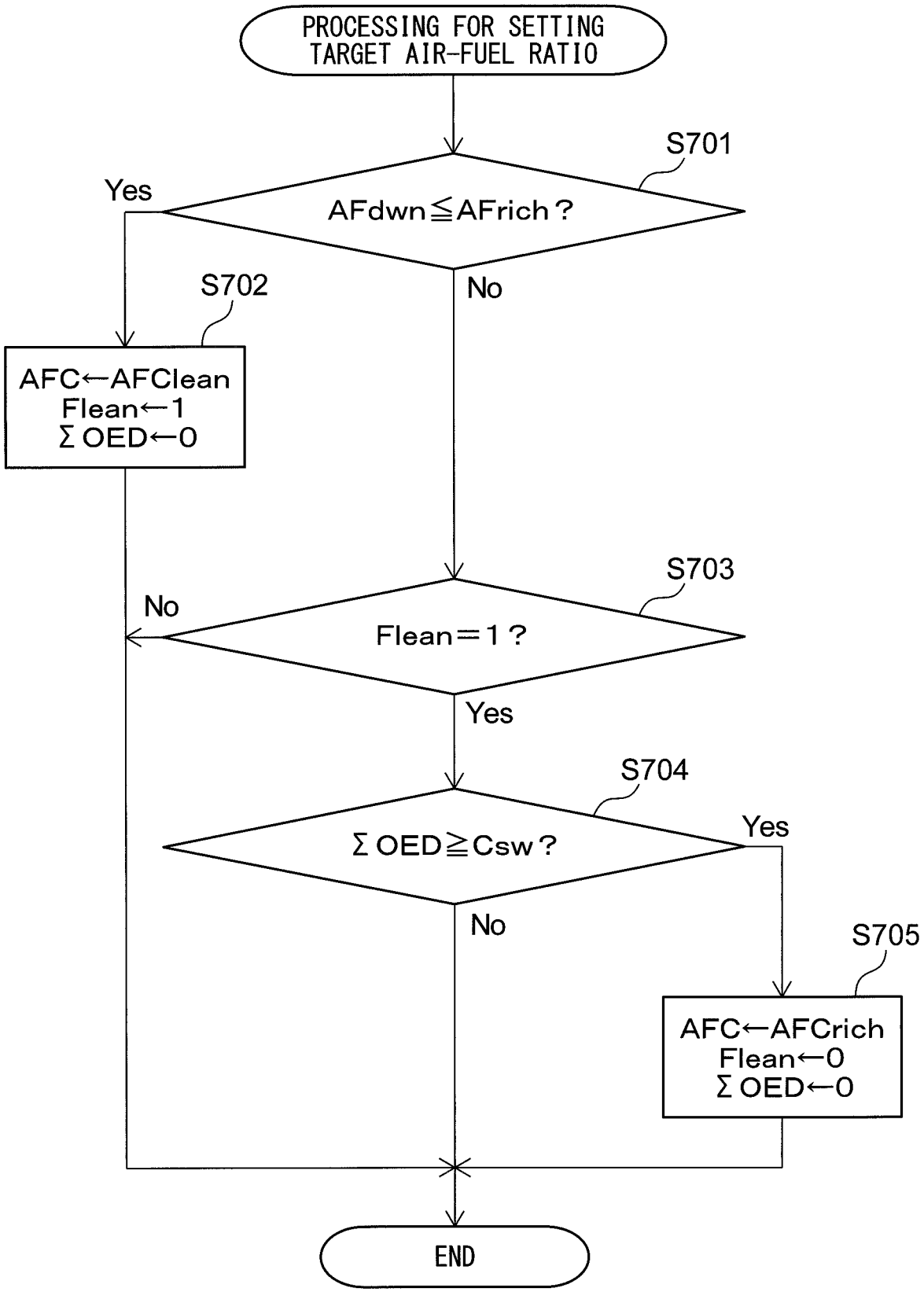
FIG. 13 is a flow chart showing a control routine of processing for setting a target air-fuel ratio in the third embodiment.

FIG. 13 is a flow chart showing a control routine of processing for setting the target air-fuel ratio in the third embodiment. The control routine is repeatedly performed after the startup of the internal combustion engine by the ECU 31 at predetermined time intervals.

First, at step S701, it is judged whether the output air-fuel ratio AFdwn of the downstream side air-fuel ratio sensor 41 is the rich judged air-fuel ratio AFrich or less. The rich judged air-fuel ratio AFrich is set at step S602 or step S604 of FIG. 12. If at step S701 it is judged that the output air-fuel ratio AFdwn of the downstream side air-fuel ratio sensor 41 is the rich judged air-fuel ratio AFrich or less, the present control routine proceeds to step S702.

At step S702, the air-fuel ratio correction amount AFC is set to the lean correction amount AFClean. That is, the target air-fuel ratio is set to the lean set air-fuel ratio. The lean correction amount AFClean is set at step S603 or step S605 of FIG. 12. Further, at step S702, the lean flag Flean is set to "1". The lean flag Flean is a flag which is set to "1" when the target air-fuel ratio is set to the lean set air-fuel ratio and which is set to zero when the target air-fuel ratio is set to the rich set air-fuel ratio. Further, at step S702, the cumulative oxygen excess/deficiency ΣOED is reset to zero.

On the other hand, if at step S701 it is judged that the output air-fuel ratio AFdwn of the downstream side air-fuel ratio sensor 41 is higher than the rich judged air-fuel ratio AFrich, the present control routine proceeds to step S703. At step S703, it is judged whether the lean flag Flean is "1". If it is judged that the lean flag Flean is zero, the present control routine ends. In this case, the air-fuel ratio correction amount AFC is maintained at the currently set value.

On the other hand, if at step S703 it is judged that the lean flag Flean is "1", the present control routine proceeds to step S704. At step S704, it is judged whether the cumulative oxygen excess/deficiency ΣOED is the switched storage amount Csw or more. The switched storage amount Csw is set at step S602 or step S604 of FIG. 12. The cumulative oxygen excess/deficiency ΣOED is calculated by cumulatively adding the oxygen excess/deficiency calculated by the above formula (1) or (2). Note that, the cumulative oxygen excess/deficiency ΣOED calculated when the target air-fuel ratio is set to the lean set air-fuel ratio corresponds to the oxygen storage amount.

If at S704 it is judged that the cumulative oxygen excess/deficiency ΣOED is less than the switched storage amount Csw, the present control routine ends. In this case, the air-fuel ratio correction amount AFC is maintained at the currently set value.

On the other hand, if at step S704 it is judged that the cumulative oxygen excess/deficiency ΣOED is the switched storage amount Csw or more, the present control routine proceeds to step S705. At step S705, the air-fuel ratio correction amount AFC is set to the rich correction amount AFCrich. That is, the target air-fuel ratio is set to the rich set air-fuel ratio. The rich correction amount AFCrich is set at step S603 or step S605 of FIG. 12. Further, at step S705, the lean flag Flean is set to zero, then the cumulative oxygen excess/deficiency ΣOED is reset to zero. After step S705, the present control routine ends.

Note that, in the third embodiment as well, in the same way as the first embodiment, the control routine for learning value updating processing of FIG. 8 is executed.

Other Embodiments

Above, preferred embodiments according to the present invention were explained, but the present invention is not limited to these embodiments. Various revisions and changes can be made within the language of the claims. For example, as parameter corrected based on the learning values, other air-fuel ratio-related parameters besides the control center air-fuel ratio may be used. Examples of the other air-fuel ratio-related parameters are the amount of supply of fuel to the insides of the combustion chambers 5, the output air-fuel ratio of the upstream side air-fuel ratio sensor 40, the air-fuel ratio correction amount, etc.

Further, the harmful substances in the exhaust gas are basically removed at the upstream side catalyst 20. For this reason, the downstream side catalyst 24 may be omitted from the exhaust purification system.

Further, when an EGR passage for recirculating a part of the exhaust gas flowing through the exhaust passage as EGR gas to the intake passage is provided in the internal combustion engine, a low EGR state where the EGR gas flow rate or EGR rate is less than a predetermined value may be the first state while a high EGR state where the EGR gas flow rate or EGR rate is the predetermined value or more may be the second state. The EGR gas flow rate is, for example, detected by a flow rate sensor provided in the EGR passage. The EGR rate is, for example, estimated by a known means based on the output of the air flow meter 39, the opening degree of the EGR valve provided in the EGR passage, etc. Note that, the "EGR rate" is the ratio of the amount of EGR gas to the total amount of gas supplied to the insides of the cylinders (total of intake air amount and amount of EGR gas). The larger the EGR gas flow rate or EGR rate, the more the concentration of $NO_X$ in the exhaust gas falls. For this reason, for example, in the first embodiment or second embodiment, the lean judged air-fuel ratio in the high EGR state is made leaner than the lean judged air-fuel ratio in the low EGR state. Further, for example, in the third embodiment, the switched storage amount in the high EGR state is made greater than the switched storage amount in the low EGR state. Note that, the high EGR state may be the first state and the low EGR state may be the second state.

Further, the high load state where the engine load is a predetermined value or more may be the first state while the low load state where the engine load is less than a predetermined value may be the second state. The engine load is detected by the load sensor 43. In the low load state, even if external disturbance occurs, the fluctuation of the air-fuel ratio of the inflowing exhaust gas due to the external disturbance is small. For this reason, for example, in the first embodiment or second embodiment, the rich judged air-fuel ratio in the low load state is made richer than the rich judged air-fuel ratio in the high load state, while the lean judged air-fuel ratio in the low load state is made leaner than the lean judged air-fuel ratio in the high load state. Further, for example, in the third embodiment, the rich judged air-fuel ratio in the low load state is made richer than the rich judged air-fuel ratio in the high load state while the switched storage amount in the low load state is made greater than the switched storage amount in the high load state. Note that, the low load state may be the first state, while the high load state may be made the second state.

REFERENCE SIGNS LIST

20. upstream side catalyst
31. ECU
40. upstream side air-fuel ratio sensor
41. downstream side air-fuel ratio sensor

The invention claimed is:

1. An exhaust purification system of an internal combustion engine comprising:

a catalyst arranged in an exhaust passage and able to store oxygen;

an upstream side air-fuel ratio sensor arranged at an upstream side of the catalyst in a direction of flow of exhaust and detecting an air-fuel ratio of inflowing exhaust gas flowing into the catalyst;

a downstream side air-fuel ratio sensor arranged at a downstream side of the catalyst in the direction of flow of exhaust and detecting an air-fuel ratio of outflowing exhaust gas flowing out from the catalyst; and an air-fuel ratio control device configured to control an air-fuel ratio of the inflowing exhaust gas, wherein the air-fuel ratio control device is configured to alternately switch a target air-fuel ratio of the inflowing exhaust gas between a rich set air-fuel ratio richer than a stoichiometric air-fuel ratio and a lean set air-fuel ratio leaner than a stoichiometric air-fuel ratio, calculate an oxygen storage amount which is an estimated value of an amount of oxygen stored at the catalyst while the target air-fuel ratio is maintained at the lean set air-fuel ratio, and an oxygen discharge amount which is an estimated value of an amount of oxygen discharged from the catalyst while the target air-fuel ratio is maintained at the rich set air-fuel ratio, based on an air-fuel ratio detected by the upstream side air-fuel ratio sensor, update a learning value based on a difference of the oxygen storage amount and the oxygen discharge amount, and correct an air-fuel ratio-related parameter based on the learning value so that the difference of the oxygen storage amount and the oxygen discharge amount becomes smaller, and an operating state of the internal combustion engine changes between a first state and a second state, and the air-fuel ratio control device is configured to change a condition for switching the target air-fuel ratio between the first state and the second state, store the learning value at the time when the operating state of the internal combustion engine changes from the first state to the second state as a first state value, and update the learning value to the first state value when the operating state of the internal combustion engine returns from the second state to the first state.

2. The exhaust purification system of an internal combustion engine according to claim 1, wherein the air-fuel ratio control device is configured to store the learning value at the time when the operating state of the internal combustion engine changes from the second state to the first state as a second state value, and update the learning value to the second state value when the operating state of the internal combustion engine returns from the first state to the second state.

3. The exhaust purification system of an internal combustion engine according to claim 1, wherein the air-fuel ratio control device is configured to switch the target air-fuel ratio from the rich set air-fuel ratio to the lean set air-fuel ratio when the air-fuel ratio detected by the downstream side air-fuel ratio sensor reaches a rich judged air-fuel ratio, and switch the target air-fuel ratio from the lean set air-fuel ratio to the rich set air-fuel ratio when the air-fuel ratio detected by the downstream side air-fuel ratio sensor reaches a lean judged air-fuel ratio, the rich judged air-fuel ratio being an air-fuel ratio richer than a stoichiometric air-fuel ratio and leaner than the rich set air-fuel ratio, and the lean judged air-fuel ratio being an air-fuel ratio leaner than a stoichiometric air-fuel ratio and richer than the lean set air-fuel ratio, and the air-fuel ratio control device is configured to change a value of at least one of the rich judged air-fuel ratio and the lean judged air-fuel ratio between the first state and the second state.

4. The exhaust purification system of an internal combustion engine according to claim 3, wherein if the oxygen storage amount reaches a threshold value before the air-fuel ratio detected by the downstream side air-fuel ratio sensor reaches the lean judged air-fuel ratio, the air-fuel ratio control device is configured to switch the target air-fuel ratio from the lean set air-fuel ratio to the rich set air-fuel ratio when the oxygen storage amount reaches the threshold value, and the air-fuel ratio control device is configured to update the threshold value based on the oxygen storage amount and the oxygen discharge amount, store the threshold value at the time when the operating state of the internal combustion engine changes from the first state to the second state as a first state threshold value, and update the threshold value to the first state threshold value when the operating state of the internal combustion engine returns from the second state to the first state.

5. The exhaust purification system of an internal combustion engine according to claim 4, wherein the air-fuel ratio control device is configured to store the threshold value at the time when the operating state of the internal combustion engine changes from the second state to the first state as a second state threshold value, and update the threshold value to the second state threshold value when the operating state of the internal combustion engine returns from the first state to the second state.

6. The exhaust purification system of an internal combustion engine according to claim 1, wherein the air-fuel ratio control device is configured to switch the target air-fuel ratio from the rich set air-fuel ratio to the lean set air-fuel ratio when the air-fuel ratio detected by the downstream side air-fuel ratio sensor reaches a rich judged air-fuel ratio and switch the target air-fuel ratio from the lean set air-fuel ratio to the rich set air-fuel ratio when the oxygen storage amount reaches a switched storage amount smaller than a maximum oxygen storage amount, the rich judged air-fuel ratio being an air-fuel ratio richer than a stoichiometric air-fuel ratio and leaner than the rich set air-fuel ratio, and the air-fuel ratio control device is configured to change a value of at least one of the rich judged air-fuel ratio and the switched storage amount between the first state and the second state.

7. The exhaust purification system of an internal combustion engine according to claim 1, wherein the air-fuel ratio control device is configured to change a value of at least one of the rich set air-fuel ratio and the lean set air-fuel ratio between the first state and the second state.

8. The exhaust purification system of an internal combustion engine according to claim 1, wherein the first state is a nonsteady state, and the second state is a steady state.

9. The exhaust purification system of an internal combustion engine according to claim 1, wherein the first state is a steady state, and the second state is a nonsteady state.

10. The exhaust purification system of an internal combustion engine according to claim 1, wherein an EGR passage for making a part of the exhaust gas flowing through the exhaust passage recirculate as EGR gas to an intake passage is provided at the internal combustion engine, and the first state is a low EGR state where an EGR gas flow rate is less than a first predetermined value and the second state is a high EGR state where the EGR gas flow rate is the first predetermined value or more, or the first state is a low EGR state where the EGR rate is less than a second predetermined value and the second state is a high EGR state where the EGR rate is the second predetermined value or more.

11. The exhaust purification system of an internal combustion engine according to claim 1, wherein an EGR passage for making a part of the exhaust gas flowing through the exhaust passage recirculate as EGR gas to an intake passage is provided at the internal combustion engine, and the first state is a high EGR state where an EGR gas flow rate is a first predetermined value or more and the second state is a low EGR state where the EGR gas flow rate is less than the first predetermined value, or the first state is a high EGR state where the EGR rate is a second predetermined value or more and the second state is a low EGR state where the EGR rate is less than the second predetermined value.

12. The exhaust purification system of an internal combustion engine according to claim 1, wherein the first state is a high load state where an engine load is a predetermined value or more, and the second state is a low load state where the engine load is less than the predetermined value.

13. The exhaust purification system of an internal combustion engine according to claim 1, wherein the first state is a low load state where an engine load is less than a predetermined value, and the second state is a high load state where the engine load is the predetermined value or more.

* * * * *